US007946545B2

(12) United States Patent
Nurenberg et al.

(10) Patent No.: US 7,946,545 B2
(45) Date of Patent: May 24, 2011

(54) WALL MOUNT ASSEMBLY

(75) Inventors: Aundrea Nurenberg, Brown City, MI (US); Michael C. Clark, Columbiaville, MI (US)

(73) Assignee: Tapco International Corporation, Wixom, MI (US)

( * ) Notice: Subject to any disclaimer, the term of this patent is extended or adjusted under 35 U.S.C. 154(b) by 753 days.

(21) Appl. No.: 11/963,211

(22) Filed: Dec. 21, 2007

(65) Prior Publication Data

US 2008/0149792 A1 Jun. 26, 2008

Related U.S. Application Data

(60) Provisional application No. 60/871,205, filed on Dec. 21, 2006.

(51) Int. Cl.
*A47B 96/06* (2006.01)

(52) U.S. Cl. ..... 248/224.8; 248/222.41; 52/220.8

(58) Field of Classification Search ..... 52/61, 97, 52/220.8; 174/50, 67, 502; 248/222.41, 248/224.8

See application file for complete search history.

(56) References Cited

U.S. PATENT DOCUMENTS 3,864,511 A * 2/1975 Morby et al. ..... 174/58
4,920,708 A * 5/1990 MacLeod et al. ..... 52/60
5,133,165 A * 7/1992 Wimberly ..... 52/220.8
5,133,168 A * 7/1992 Neilly et al. ..... 52/204.5
5,397,093 A * 3/1995 Chubb et al. ..... 248/544
5,598,670 A * 2/1997 Humphrey et al. ..... 52/220.8
5,644,881 A * 7/1997 Neilly ..... 52/455
6,310,287 B1 * 10/2001 Schiedegger et al. ..... 174/50
6,553,735 B1 * 4/2003 Wang Chen ..... 52/455
6,723,921 B2 * 4/2004 Vagedes ..... 174/58
6,780,100 B1 * 8/2004 Gretz ..... 454/359
6,825,414 B2 * 11/2004 Vagedes ..... 174/58
7,549,258 B2 * 6/2009 Lajewski ..... 52/220.8
2001/0015281 A1 8/2001 Schiedegger et al.
2001/0025717 A1 10/2001 Schiedegger et al.
2007/0224866 A1 9/2007 Clark et al.

* cited by examiner

*Primary Examiner* — Terrell McKinnon
*Assistant Examiner* — Daniel J Breslin
(74) *Attorney, Agent, or Firm* — Howard & Howard Attorneys PLLC

(57) ABSTRACT

A wall mount assembly for mounting to a building is described. The wall mount assembly includes a base member having a front surface and a rear surface and having a wall extending about an outer periphery and inwardly from the rear surface. The base member also includes at least one edge recessed rearwardly from the front surface defining a recessed portion therein. The edge of the recessed portion also defines mounting apertures, mounting holes and/or mounting surfaces spaced about the recessed portion. An annular flange extends rearwardly from the recessed portion. An insert member and/or a cover member mount to either one of the mounting apertures, mounting holes and/or mounting surfaces for creating an aesthetic appearance.

13 Claims, 23 Drawing Sheets

WALL MOUNT ASSEMBLY

CROSS-REFERENCE TO RELATED APPLICATION

The instant application claims priority to U.S. Provisional Patent Application Ser. No. 60,871,205, filed Dec. 21, 2006, the entire specification of which is expressly incorporated herein by reference.

BACKGROUND OF THE INVENTION

1. Field of the Invention

The present invention generally relates to a wall mount assembly for mounting to a building, and more specifically to a wall mount assembly that comprises a base member operable to receive various insert members and/or cover members for different applications.

2. Description of the Related Art

Wall mount assemblies generally include a base member that attaches directly to a building prior to securing siding material to the building. After the base member is mounted to the building, the siding material is secured to the building, and then a cover member mounts to the base member. The cover member has a recessed portion for receiving an insert. Generally, the cover member has various sizes depending upon the particular application, such as vent hoods or wall mounts.

One drawback to the related art wall mount assemblies is that the base member is mounted underneath the siding material directly to the building. Therefore, the base member must be installed prior to the siding material. For existing buildings, the siding material must be removed.

Attempts have been made to manufacture one-piece wall mount assemblies that are mounted over the siding material and that do not require the base members. However, one drawback to one-piece wall mount assemblies is that multiple configurations are needed for different applications and the cost of manufacturing the multiple configurations is increased. Also, these assemblies require additional components to seal between the siding material and the assembly.

Accordingly, there exists a need for new and improved wall mount assemblies that overcome at least one of the aforementioned problems.

SUMMARY OF THE INVENTION

The present invention provides a wall mount assembly for mounting to a building. The wall mount assembly includes a base member having a front surface and a rear surface and having a wall extending about an outer periphery and inwardly from the rear surface. The base member also includes at least one edge recessed rearwardly from the front surface defining a recessed portion therein. The edge of the recessed portion also defines mounting apertures, mounting holes and/or mounting surfaces spaced about the recessed portion. An annular flange extends rearwardly from the recessed portion. An insert member and/or a cover member mount to either one of the mounting apertures, mounting holes and/or mounting surfaces for creating an aesthetic appearance.

The present invention can be used as a universal connector for mounting various cover members to a building, such as but not limited to those buildings having surfaces comprised of cementitious material (e.g., cement board siding and/or the like). Because a single base member is operable with different insert members and/or cover members, manufacturing costs are lessened and installation is simplified. Additionally, the present invention mounts directly to the building without a member mounted beneath the siding material. Therefore, the wall mount assembly may be added to existing buildings without having to remove the siding material and existing buildings can be retrofitted. Installation only requires the requisite amount of siding material to be removed, such as by cutting a hole, that corresponds to the annular flange of the base member.

Further areas of applicability of the present invention will become apparent from the detailed description provided hereinafter. It should be understood that the detailed description and specific examples, while indicating the preferred embodiment of the invention, are intended for purposed of illustration only and are not intended to limit the scope of the invention.

BRIEF DESCRIPTION OF THE DRAWINGS

The present invention will become more fully understood from the detailed description and the accompanying drawings, wherein.

The same reference numerals refer to the same parts throughout the various Figures.

DETAILED DESCRIPTION OF THE INVENTION

Figure 1:
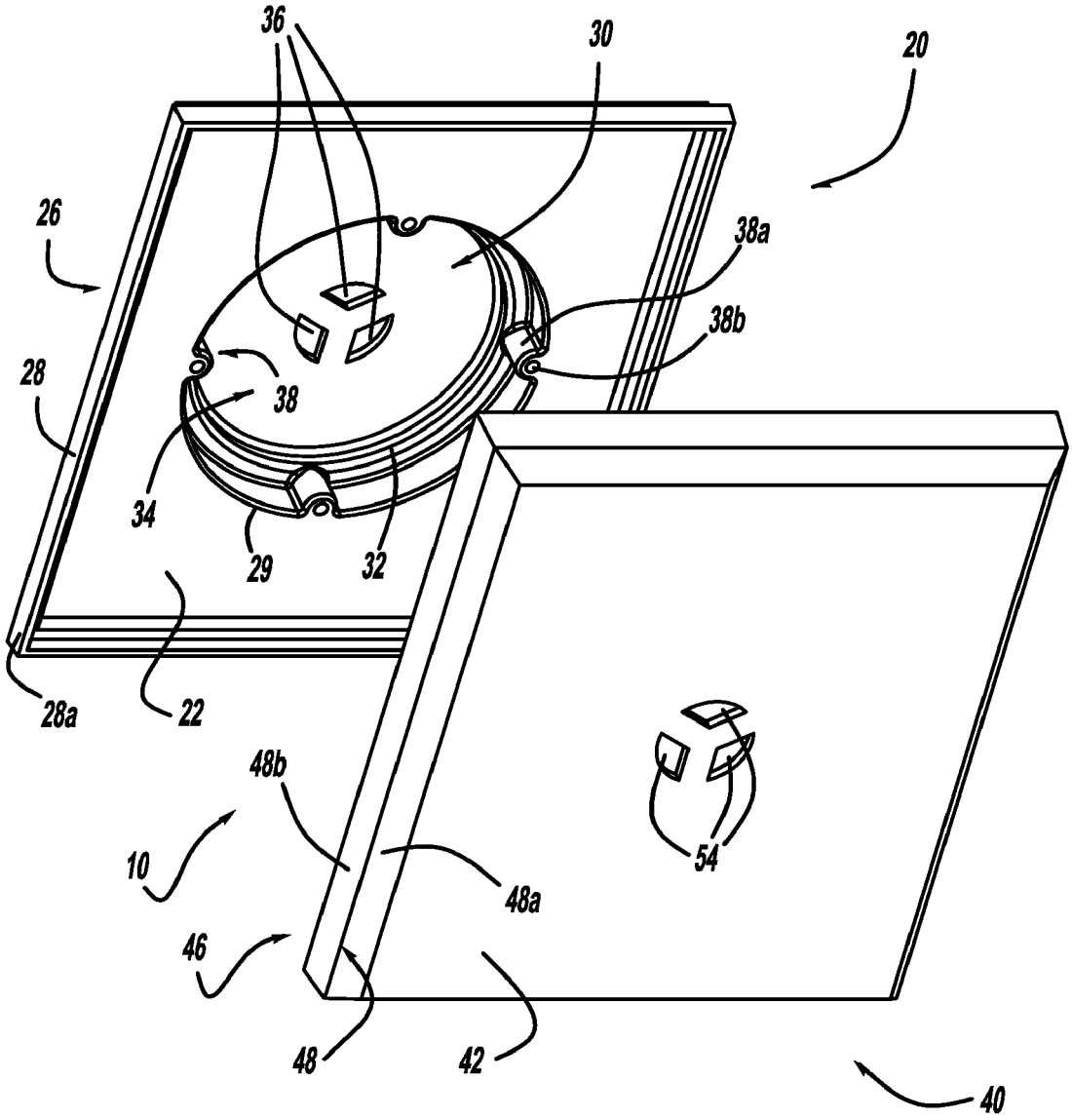
FIG. 1 is a front exploded view of a first embodiment of a wall mount assembly according to the present invention.
Figure 2:
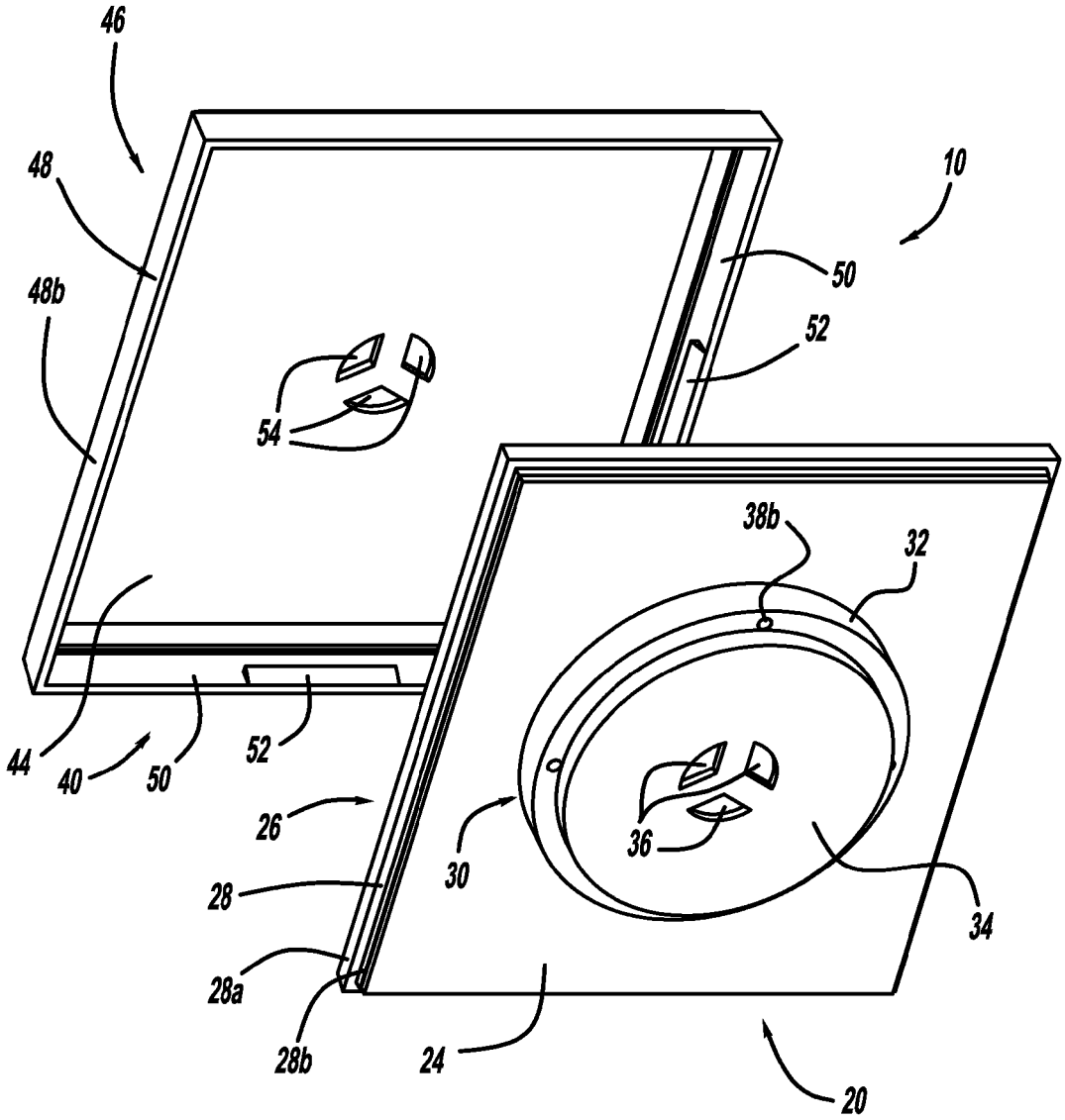
FIG. 2 is a rear exploded view of the wall mount assembly depicted in FIG. 1.
Figure 3:
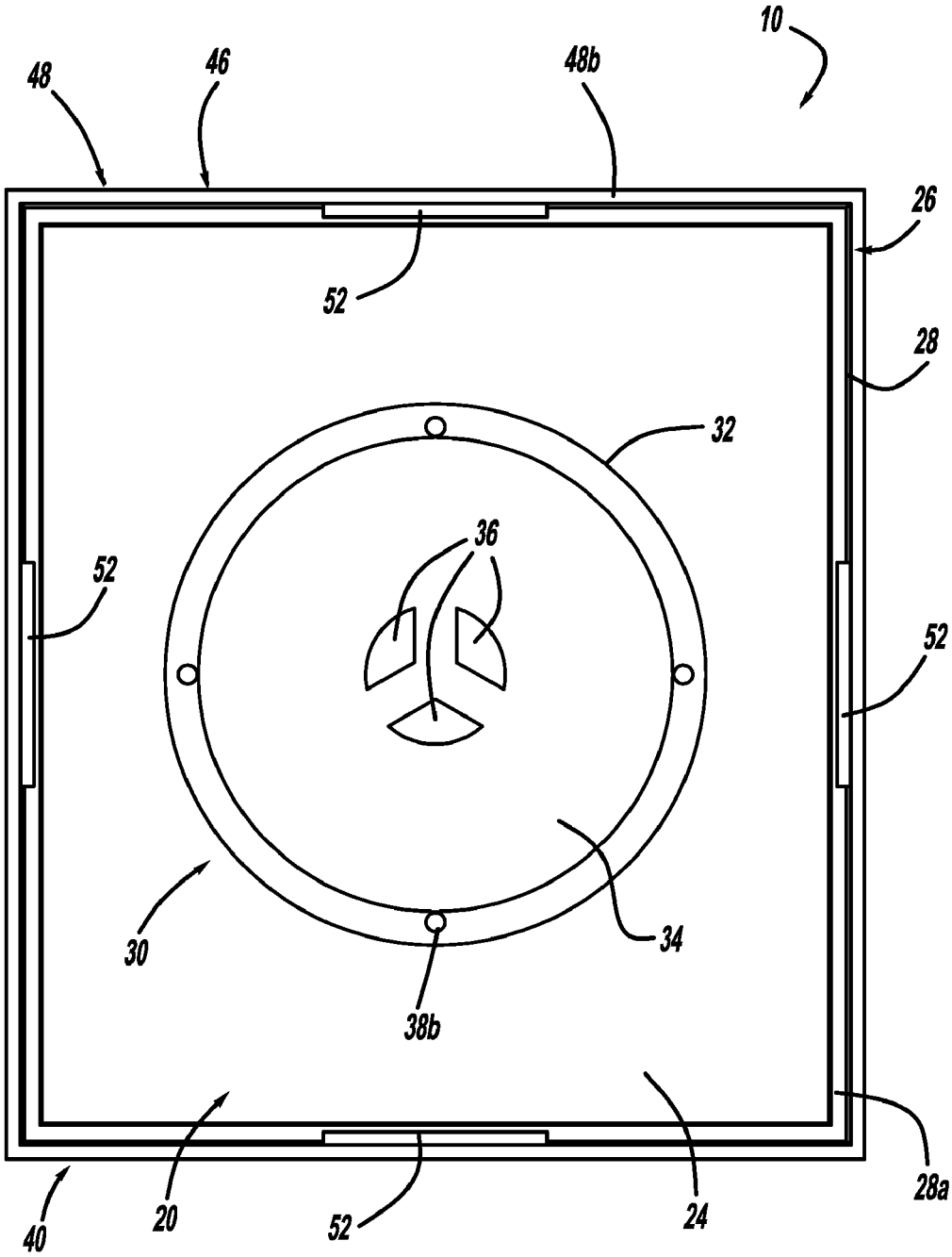
FIG. 3 is a rear elevational view of the wall mount assembly depicted in FIG. 1.
Figure 4:
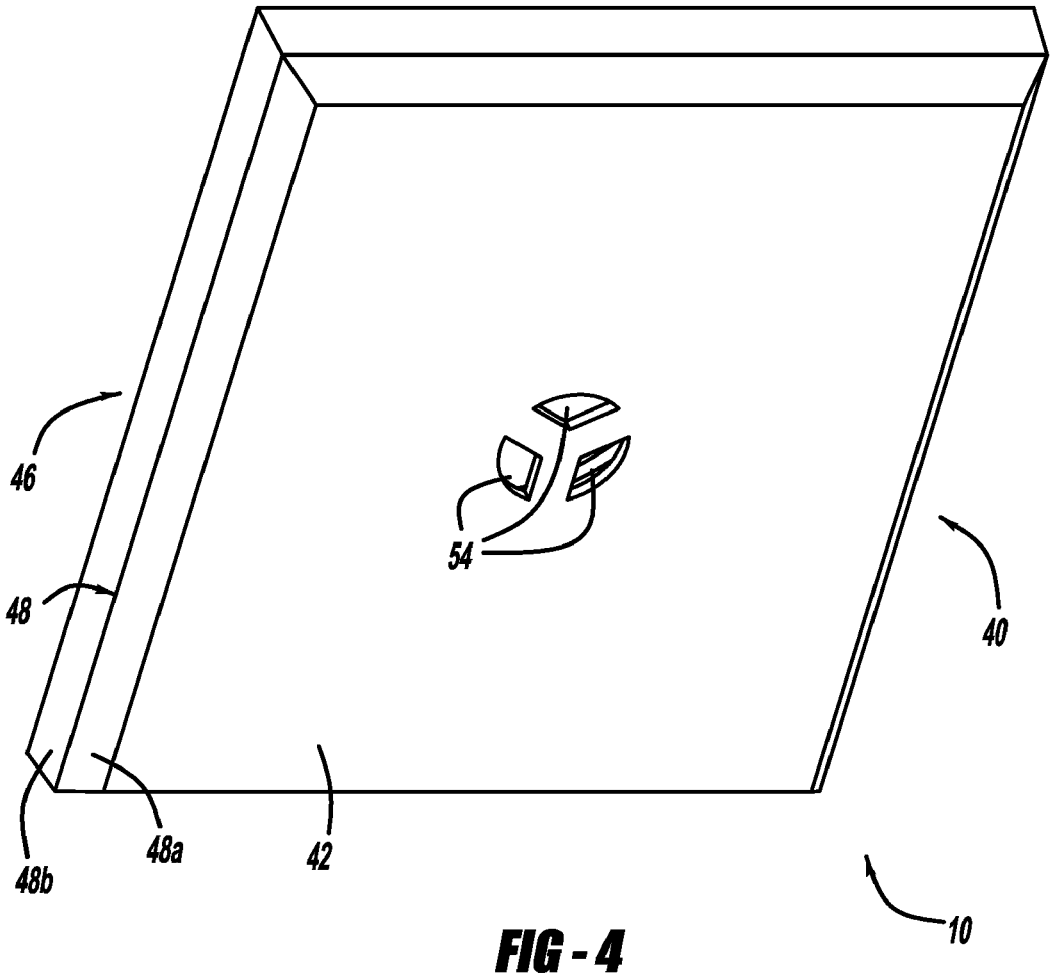
FIG. 4 is a front perspective view of the wall mount assembly depicted in FIG. 1.
Figure 5:
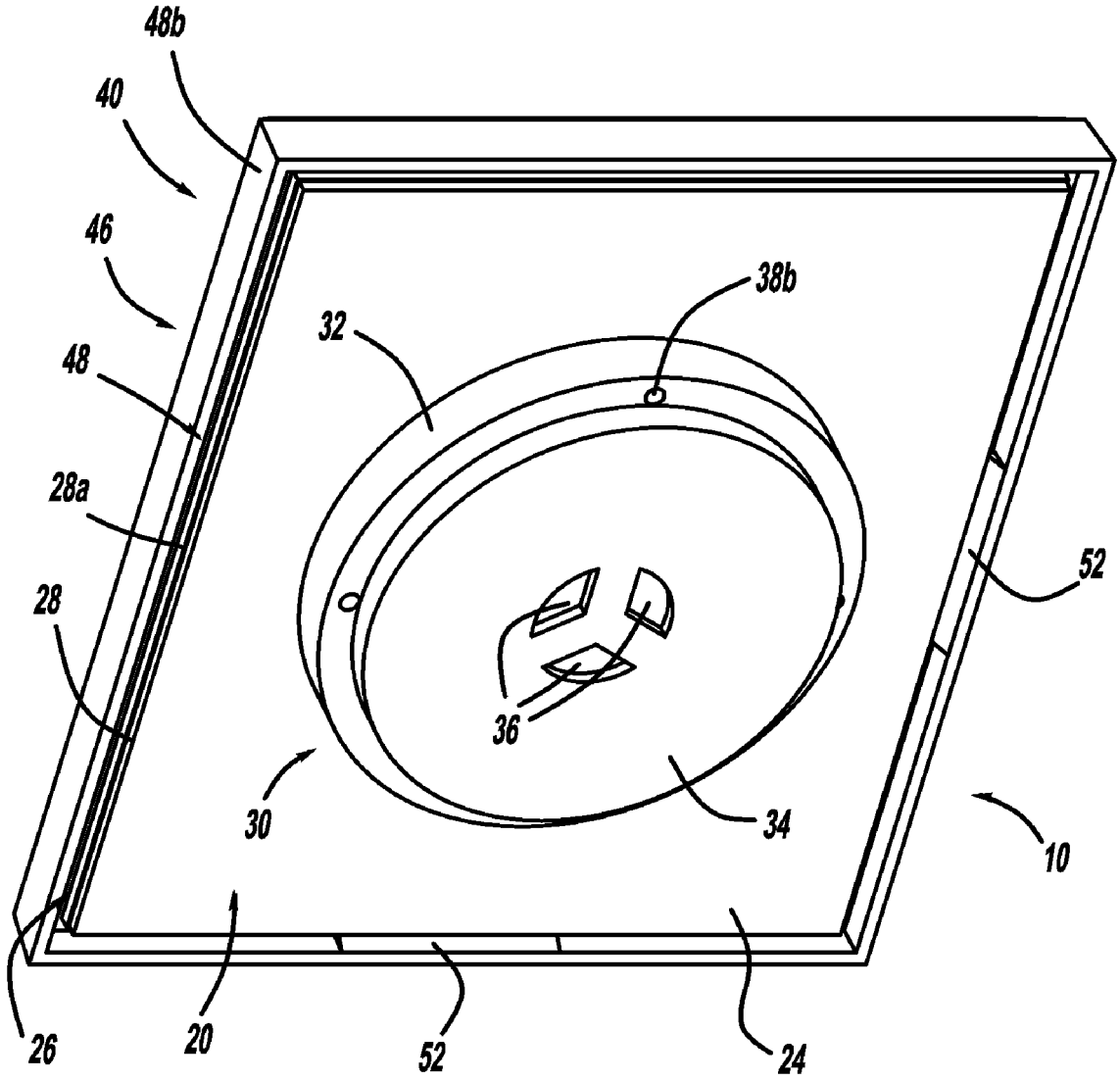
FIG. 5 is a rear perspective view of the wall mount assembly depicted in FIG. 1.
Figure 6:
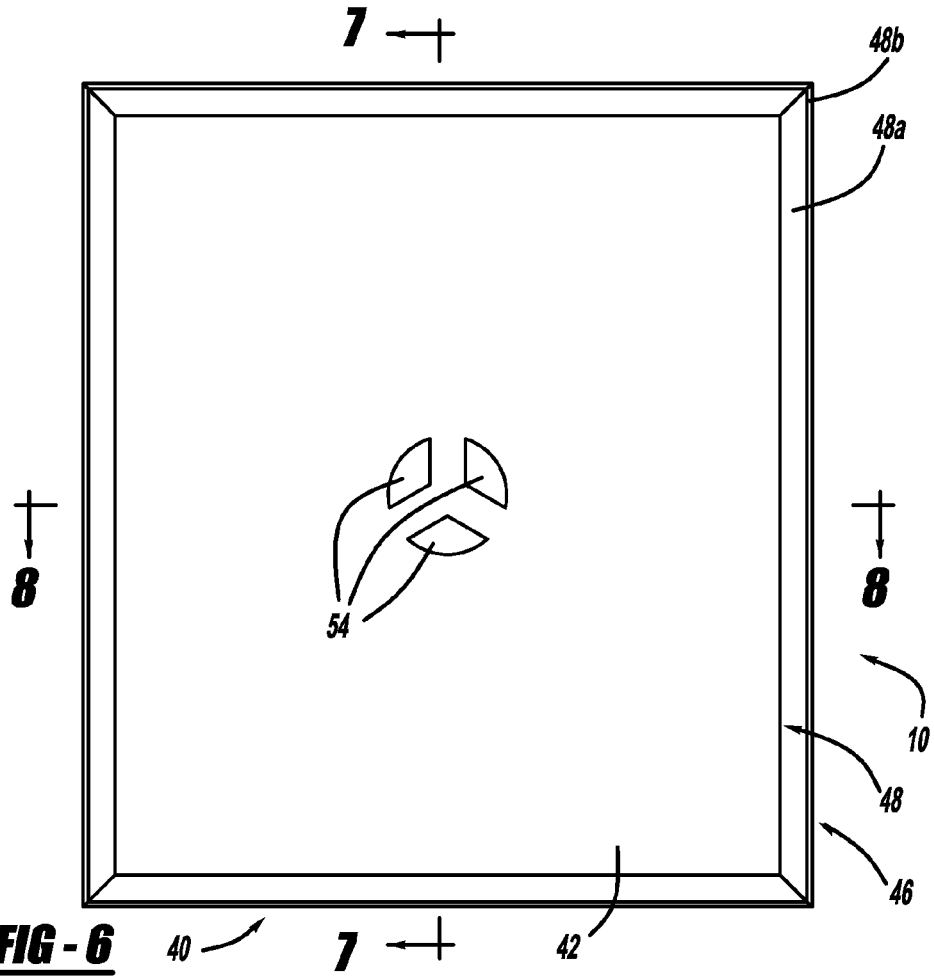
FIG. 6 is a front elevational view of the wall mount assembly depicted in FIG. 1.
Figure 8:
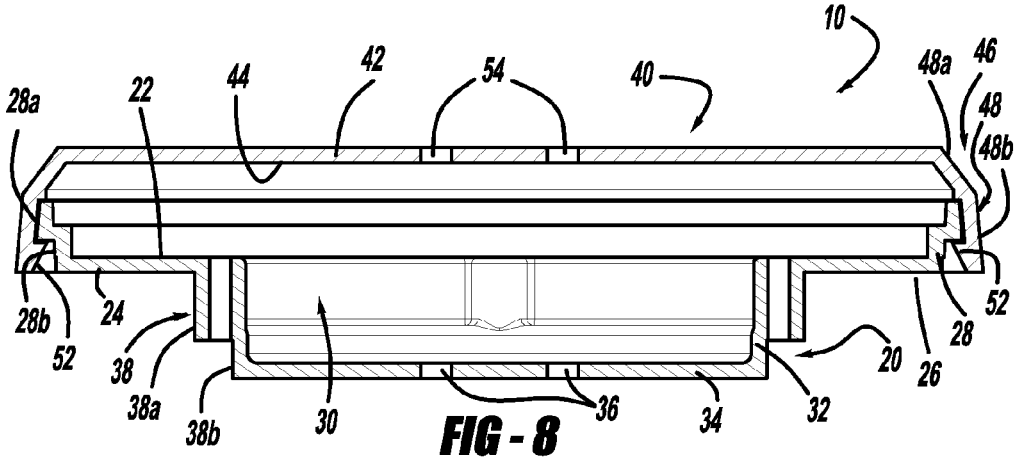
FIG. 8 is a sectional view taken along line 8-8 in FIG. 6 of the wall mount assembly.
Figure 7:
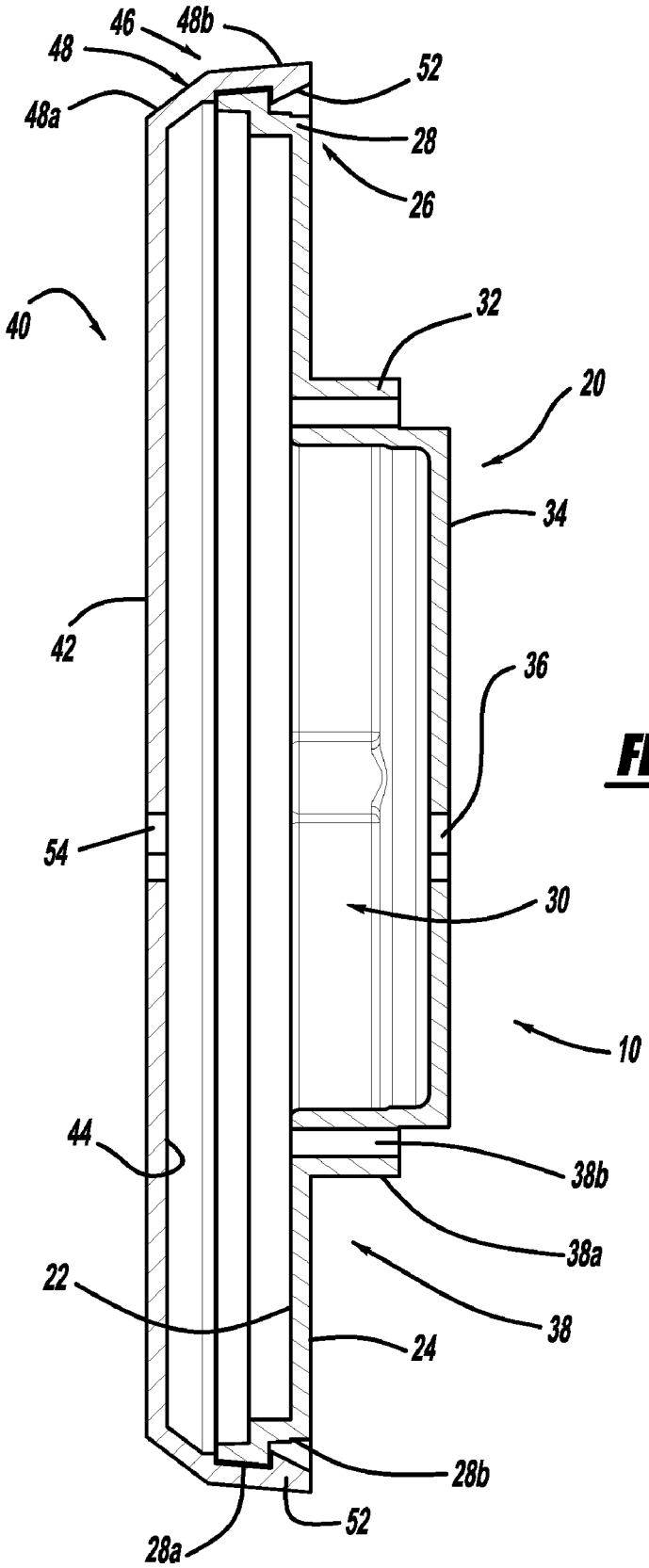
FIG. 7 is a sectional view taken along line 7-7 in FIG. 6 of the wall mount assembly.
Figure 9:
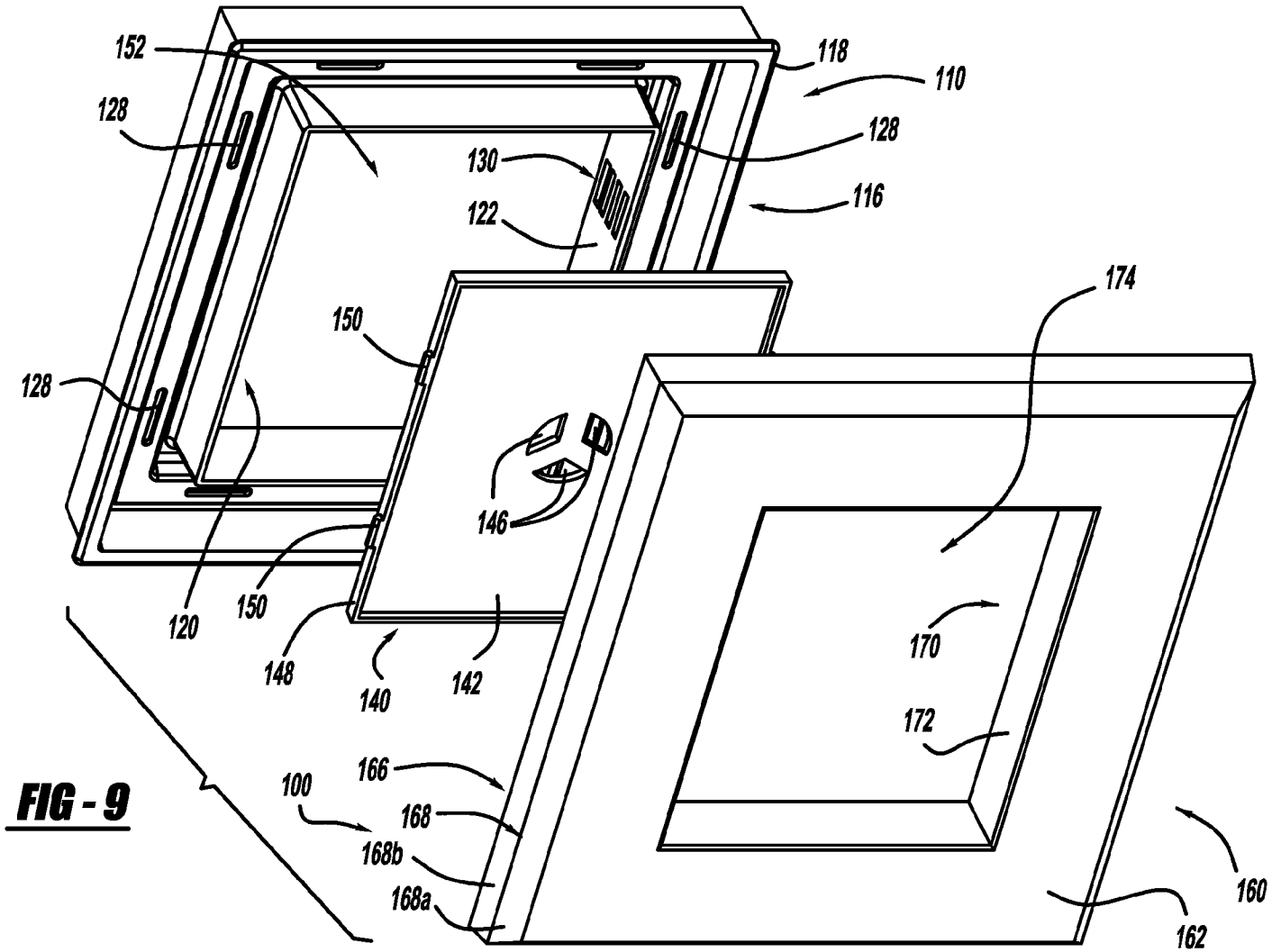
FIG. 9 is a front exploded view of a second embodiment of a wall mount assembly according to the present invention.
Figure 10:
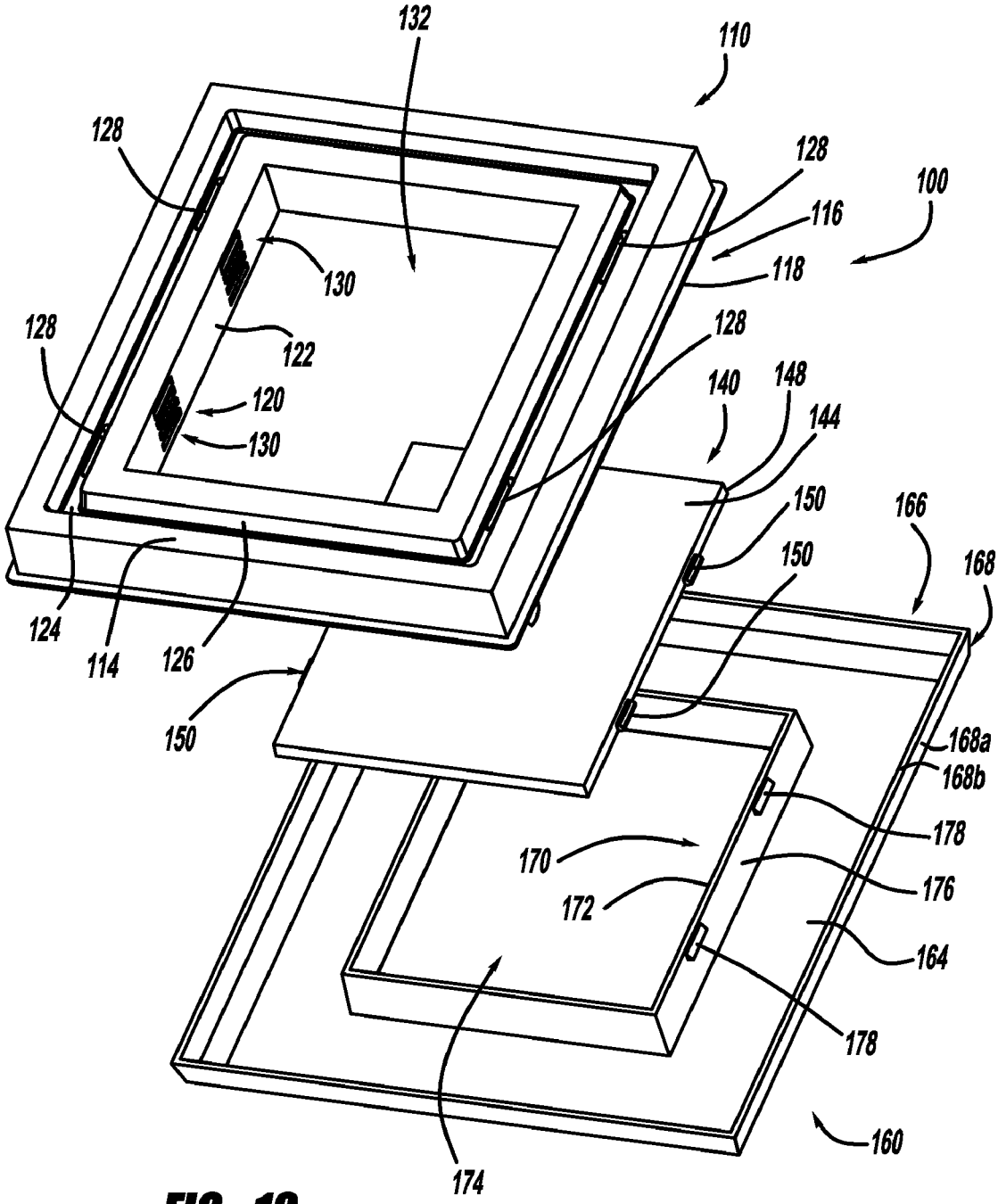
FIG. 10 is a rear exploded view of the wall mount assembly depicted in FIG. 9.
Figure 11:
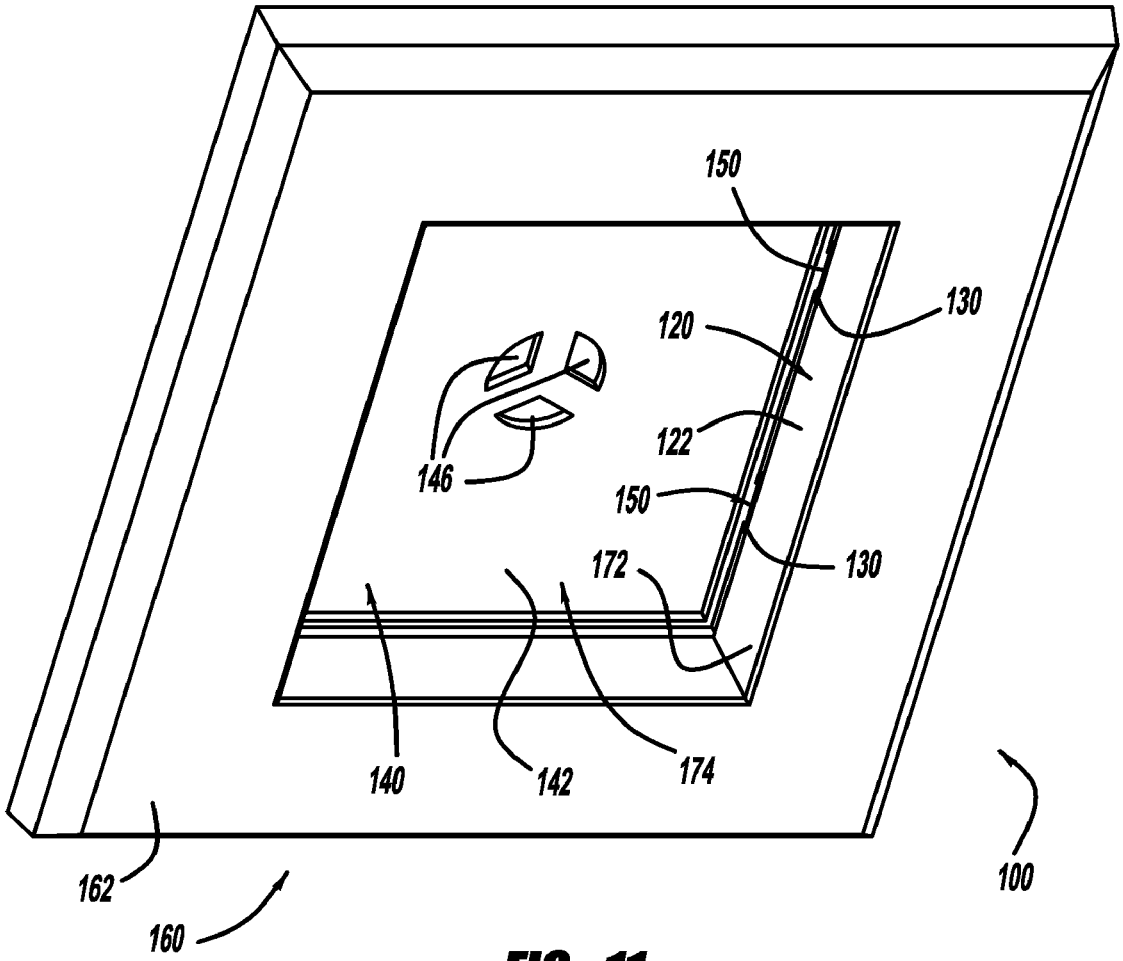
FIG. 11 is a front perspective view of the wall mount assembly depicted in FIG. 9.
Figure 12:
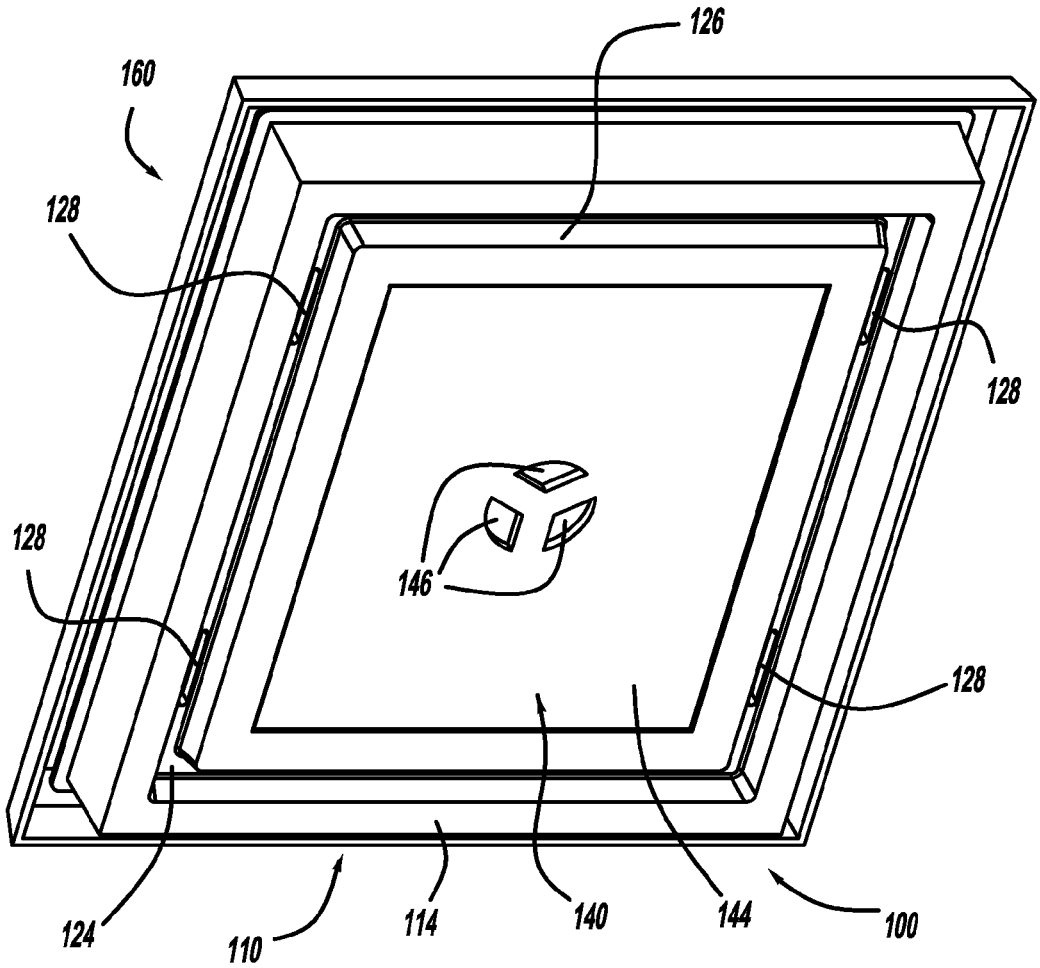
FIG. 12 is a rear perspective view of the wall mount assembly depicted in FIG. 9.
Figure 13:
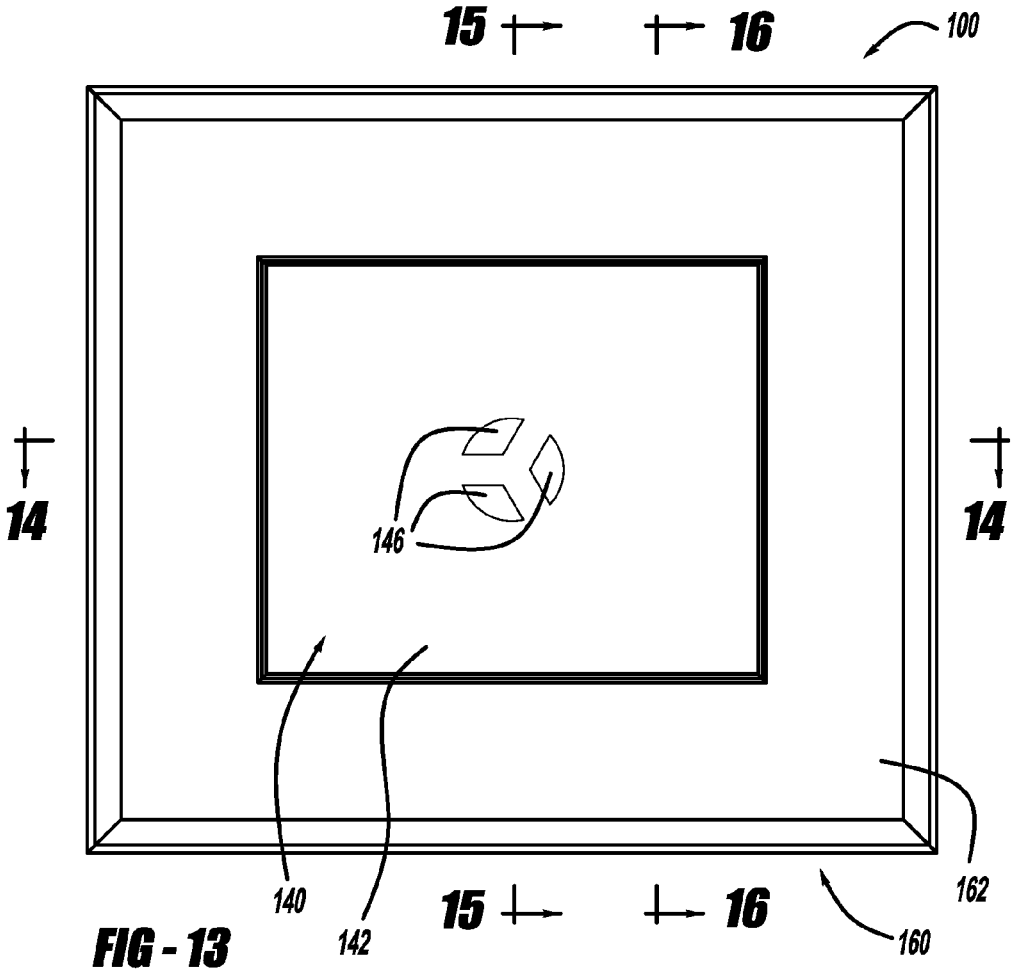
FIG. 13 is a front elevational view of the wall mount assembly depicted in FIG. 9.
Figure 14:
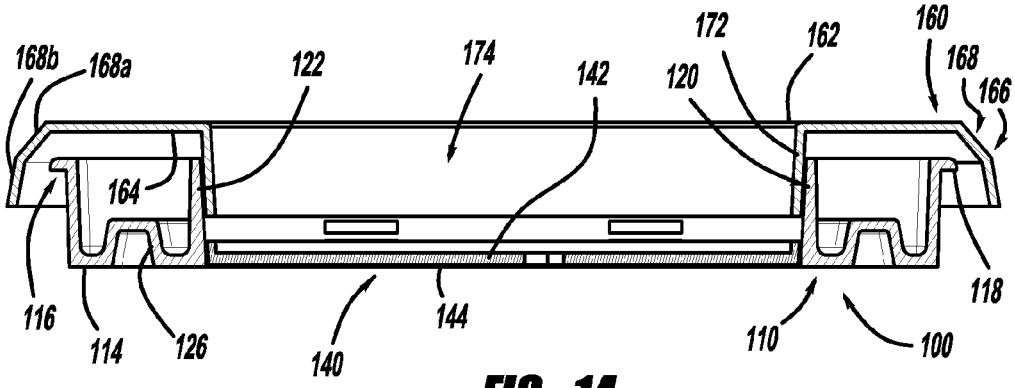
FIG. 14 is a sectional view taken along line 14-14 of the wall mount assembly depicted in FIG. 13.
Figure 16:
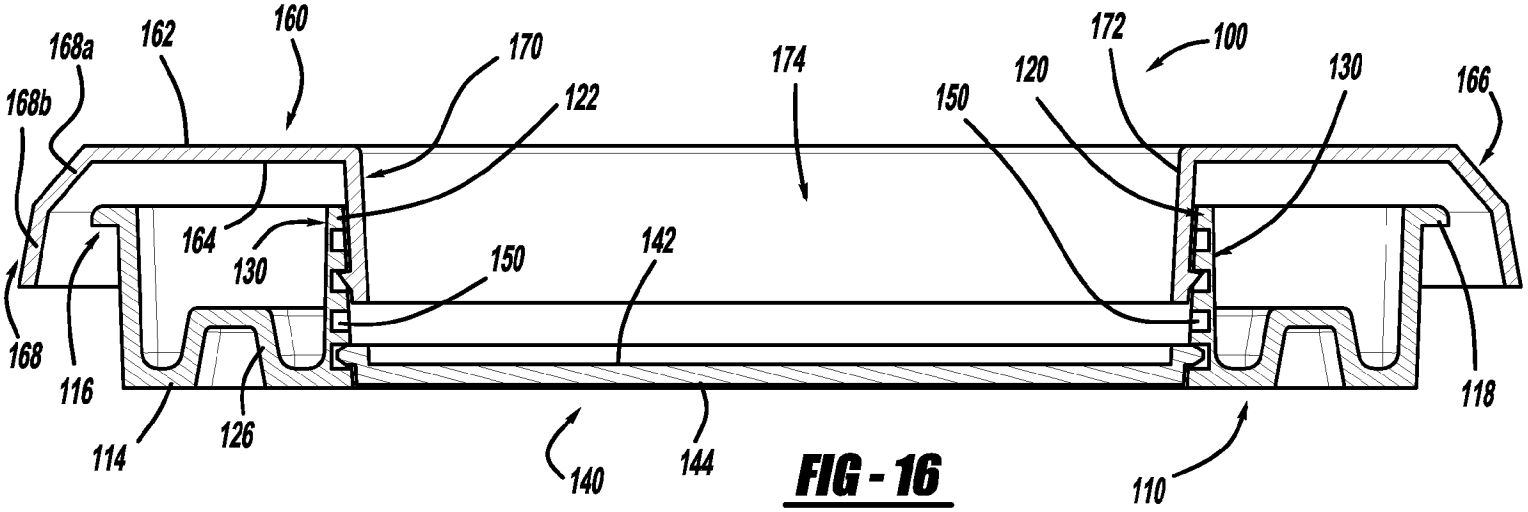
FIG. 16 is a sectional view taken along line 16-16 in FIG. 13 of the wall mount assembly.
Figure 15:
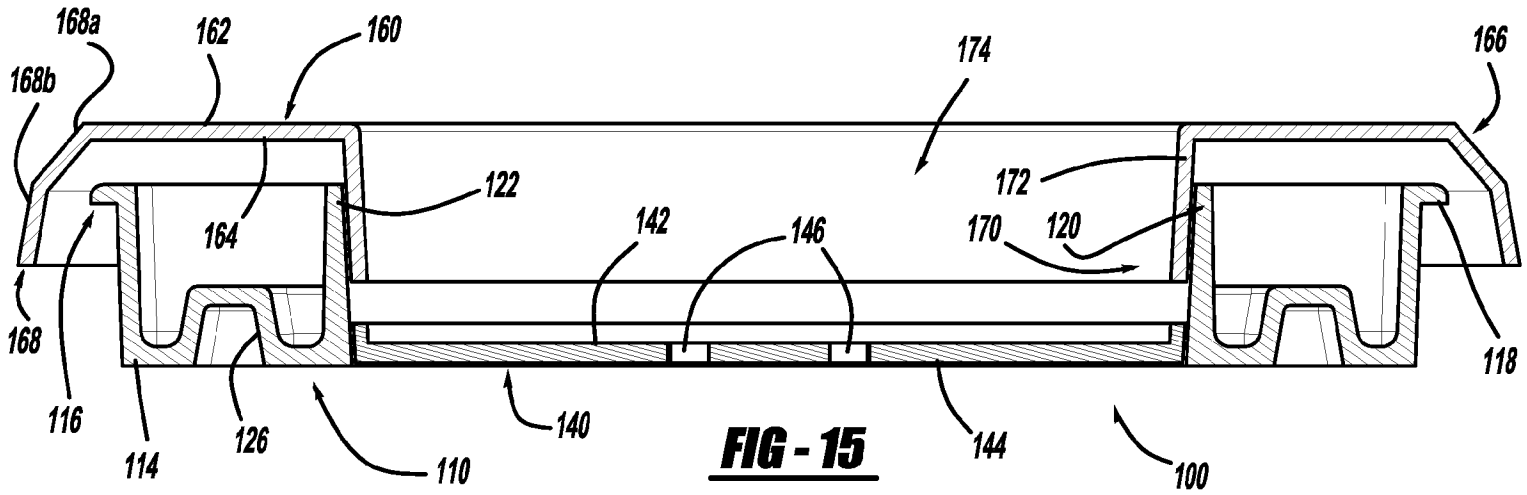
FIG. 15 is a sectional view taken along line 15-15 in FIG. 13 of the wall mount assembly.

Referring generally to the Figures, various wall mount assemblies, and methods for attaching them as well as any optional components associated therewith, to a surface, such as but not limited to a building, are shown in accordance with the general teachings of the present invention. By way of a non-limiting example, the various wall mount assemblies of the present invention can be mounted to a building having a siding material disposed thereon. The present invention is particularly useful when used in conjunction with a cement siding material; however, the present invention can also be practiced with other siding materials, such as but not limited to vinyl or aluminum siding materials.

Referring specifically to FIGS. 1-8, there is shown a first embodiment of the wall mount assembly 10, including a base member 20 and a cover member 40. The wall mount assembly 10 may be used to secure various fixtures to the building, such as light fixtures, house numbers, ornamental fixtures, and/or the like.

The base member 20 is generally planar and includes a front surface 22 and a rear surface 24. The base member 20 can be any desired geometrical shape, such as rectangular, square, circular, or the like, depending upon the particular application of the wall mount assembly 10.

The base member 20 defines an outer periphery 26 and has a wall member 28 extending about the outer periphery 26 and inwardly from the rear surface 24. When the wall mount assembly 10 is mounted to the building, the wall member 28 abuts against the siding material to create an aesthetic appearance.

The base member 20 also includes at least one edge 29 recessed rearwardly from the front surface 22 defining a recessed portion 30 therein. Preferably, the edge 29 is continuous about the recessed portion 30; however, the edge 29 may be discontinuous. Although the recessed portion 30 is shown as being substantially circular, it may also have any desired geometrical shape depending upon the application of the wall mount assembly 10. An annular flange member 32 extends rearwardly from the recessed portion 30. The annular flange member 32 may define an opening or may be closed depending upon the application of the wall mount assembly 10. At the bottom of the recessed portion 30, an end wall member 34 is shown at the distal end of the flange member 32. The end wall member 34 can be closed, perforated, scored, or as in this case, provided with one or more apertures 36, e.g., for receiving or threading wires, cables, cords, and/or the like.

Additionally, the front surface 22 and/or the recessed portion 30 defines at least one, more preferably at least two, and still more preferably a plurality of fastening holes 38 (e.g., bosses 38*a* with associated threaded holes 38*b*) spaced about the recessed portion 30. By way of a non-limiting example, fasteners (e.g., screws, nails and/or the like) are inserted through the fastening holes 38 for securing the wall mount assembly 10 to the building.

In accordance with one aspect of the present invention, the wall member 28 includes an outer shoulder portion 28*a* and an inner shoulder portion 28*b* which provide a "stepped" shoulder configuration, the intended purpose of which will be explained herein in more detail.

For example, during installation, the siding material is removed (e.g., with a standard circular hole saw) in a shape corresponding to and slightly larger than the annular flange 32. The annular flange 32 is aligned with the opening in the siding material and fasteners are inserted through the fastening holes 38. Preferably, a sufficient amount of siding material is removed to allow the fasteners to directly engage the building without contacting the siding material. A gap may be created between the siding material and the annular flange 32 if the opening in the siding material is larger than the annular flange 32. A sealant (e.g., caulk) can be applied to cover any gaps or openings around the annular flange 32 or the outer periphery 26 and the siding material.

The cover member 40 can have various configurations depending upon the application of the wall mount assembly 10 as will be described below. The cover member 40 is generally planar and includes a front surface 42 and a rear surface 44. The cover member 40 can be any desired geometrical shape, such as rectangular, square, circular, or the like, depending upon the particular application of the wall mount assembly 10.

The cover member 40 defines an outer periphery 46 and has a wall member 48 extending about the outer periphery 46 and outwardly from the rear surface 44. When the cover member 40 is mounted to the base member 20, the wall member 48 abuts against base member 20 to create an aesthetic appearance. Additionally, a portion of the wall member 48 can be inclined so to create two wall surfaces 48*a*, 48*b*, respectively.

On an inner surface 50 of the wall member 48, there are formed at least one, more preferably at least two, and still more preferably a plurality of wedge members 52, the intended purpose of which will be described in more detail herein. In order to mate the cover member 40 to the base member 20, the cover member 40 is manipulated such that the two members are substantially aligned. The cover member 40 is then lowered onto the base member 20 so that the wedge members 52 pass over the outer shoulder portion 28*a* and abut against the inner shoulder portion 28*b* such that the cover member 40 is held firmly in place. The cover member 40, as well as the base member 20, are comprised of materials that have some flexibility, such as but not limited to plastic materials, such that the cover member 40, especially the wedge members 52, can flex or deform when passing over the outer shoulder portion 28*a* but can also spring back into place over the inner shoulder portion 28*b*. Should it become necessary to remove the cover member 40 from the base member 20, the cover member 40 would be grasped and pulled upwardly away from the base member 20 until the wedge members 52 flex, deform or otherwise slide over the outer shoulder portion 28*a*, thus freeing the cover member 40.

Additionally, the cover member 40 can be provided with one or more apertures 54, e.g., for receiving or threading wires, cables, cords, and/or the like. Preferably, the apertures 36 of the base member 20 are substantially aligned with the apertures 54 of the cover member to facilitate the receiving or threading wires, cables, cords, and/or the like therethrough.

Referring specifically to FIGS. 9-16, there is shown a second embodiment of a wall mount assembly 100, including a base member 110, an optional insert member 140, and a cover member 160.

The base member 110 includes a front surface 112 and a rear surface 114. The base member 110 can be any desired geometrical shape, such as rectangular, square, circular, or the like, depending upon the particular application of the wall mount assembly 100.

The base member 110 defines an outer periphery 116 having an outer wall member 118 extending about the outer periphery 116 and an inner periphery 120 having an inner wall member 122 extending around the inner periphery 120. A groove 124 is disposed about the rear surface 114 so as to define an intermediate wall member 126. At least one, more preferably at least two, and still more preferably a plurality of fastening holes 128 are spaced in the groove 124 for mounting the base member 110 to a surface, such as but not limited to a building. When the wall mount assembly 100 is mounted to the building, the outer wall member 118 abuts against the siding material to create an aesthetic appearance. By way of a non-limiting example, fasteners (e.g., screws, nails and/or the like) are inserted through the fastening holes 128 for securing the wall mount assembly 100 to the building.

The inner wall member 122 includes at least one, more preferably at least two, and still more preferably a plurality of notch portions 130 formed therein, the intended purpose of which will be described herein in more detail.

An optional insert member 140 can also be used in conjunction with the base member 110. The insert member 140 is substantially planar and includes a front surface 142 and a rear surface 144. The insert member 140 can be provided with one or more apertures 146, e.g., for receiving or threading wires, cables, cords, and/or the like.

Along a peripheral wall member 148, at least one, more preferably at least two, and still more preferably a plurality of tab members 150 are formed thereon, the intended purpose of which will be described herein in more detail.

In order to mate the insert member 140 to the base member 110, the insert member 140 is manipulated such that the two members are substantially aligned. The insert member 140 is then lowered into the aperture 132 formed in the base member 110 so that the tab members 150 are able to slip into the notch portions 130. Although four individual notch portions 130 are shown at varying heights along various locations of the inner wall member 122, it should be appreciated that either less than or more than this number can be employed, such that the insert member 140 can either be placed low within the recess 132 or high within the recess 132. Preferably, all four of the tab members 150 are inserted into four of the notch portions 130 that are at the same elevation to one another such that the insert member 140 is level.

The insert member 140, as well as the base member 110, are comprised of materials that have some flexibility, such as but not limited to plastic materials, such that the insert member 140, especially the tab members 150, can flex or deform when passing into the notch portions 130. Should it become necessary to remove the insert member 140 from the base member 110, the insert member 140 would be grasped and pulled upwardly away from the base member 110 until the tab members 150 flex, deform or otherwise slide out from the notch portions 130, thus freeing the insert member 140.

During installation, the siding material is removed in a shape corresponding to and slightly larger than the outer wall member 118. The outer wall member 118 is aligned with the opening in the siding material and fasteners are inserted through the fastening holes 128. Preferably, a sufficient amount of siding material is removed to allow the fasteners to directly engage the building without contacting the siding material. A gap may be created between the siding material and the outer wall member 118 if the opening in the siding material is larger than the outer wall member 118. A sealant can be applied to cover any gaps or openings around the outer wall member 118 or the outer periphery 116 and the siding material.

The cover member 160 can have various configurations depending upon the application of the wall mount assembly 100 as will be described below. The cover member 160 is generally planar and includes a front surface 162 and a rear surface 164. The cover member 160 can be any desired geometrical shape, such as rectangular, square, circular, or the like, depending upon the particular application of the wall mount assembly 100.

The cover member 160 defines an outer periphery 166 including an outer wall member 168 extending about the outer periphery 166 and outwardly from the rear surface 164, and an inner periphery 170 including an inner wall member 172. The inner wall member 172 defines an aperture 174. When the cover member 160 is mounted to the base member 110, the outer wall member 168 abuts against the base member 110 to create an aesthetic appearance. Additionally, a portion of the outer wall member 168 can be inclined so to create two wall surfaces 168*a*, 168*b*, respectively.

On an outer surface 176 of the inner wall member 172, there are formed at least one, more preferably at least two, and still more preferably a plurality of tab members 178, the intended purpose of which will be described in more detail herein. In order to mate the cover member 160 to the base member 110, the cover member 160 is manipulated such that the two members are substantially aligned. The cover member 160 is then lowered onto the base member 110 so that the tab members 178 are able to slip into the notch portions 130 such that the cover member 160 is held firmly in place. Preferably, all four of the tab members 178 are inserted into four of the notch portions 130 that are at the same elevation to one another such that the cover member 160 is level.

The cover member 160, as well as the base member 110, are comprised of materials that have some flexibility, such as but not limited to plastic materials, such that the cover member 160, especially the tab members 178, can flex or deform when sliding into the notch portions 130. Should it become necessary to remove the cover member 160 from the base member 110, the cover member 160 would be grasped and pulled upwardly away from the base member 110 until the tab members 178 flex, deform or otherwise slide out of the notch portions 130, thus freeing the cover member 160.

Figure 17:
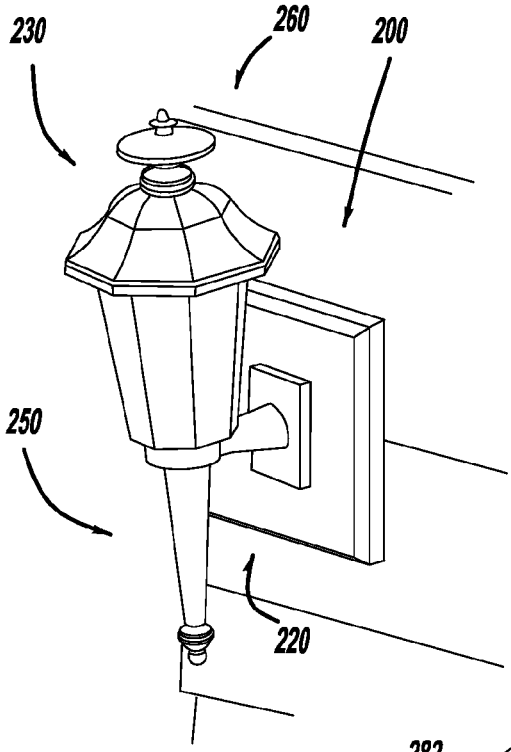
FIG. 17 is a perspective view of a third embodiment of a wall mount assembly according to present invention, wherein an optional lamp member is shown for illustrative purposes.
Figure 18:
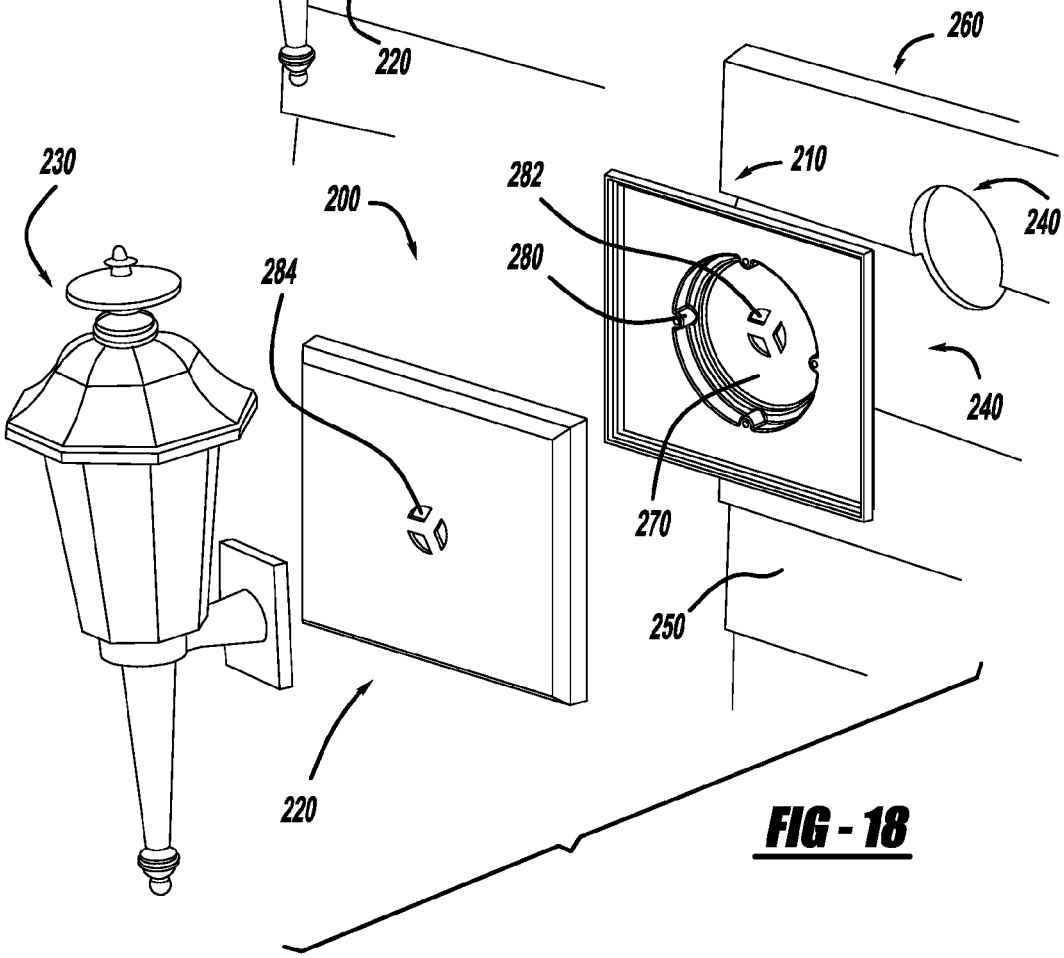
FIG. 18 is an exploded view of the wall mount assembly depicted in FIG. 17, wherein an optional lamp member is shown for illustrative purposes.
Figure 19:
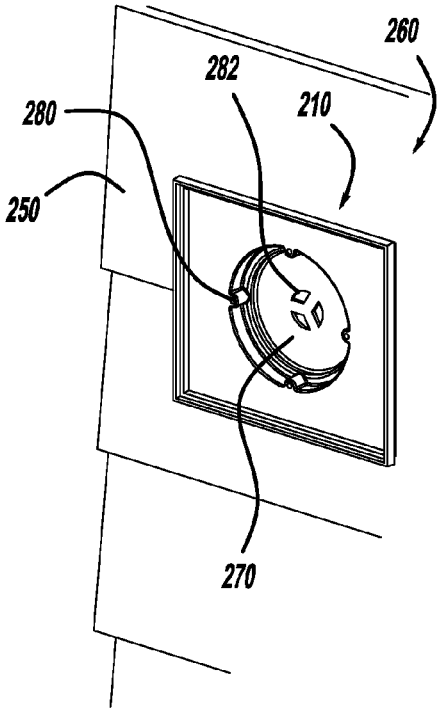
FIG. 19 is a perspective view of the mount assembly depicted in FIG. 17, wherein only the base member is shown mounted to a wall of a building.

Referring specifically to FIGS. 17-19, there is shown a third embodiment of a wall mount assembly 200, including a base member 210, a cover member 220, and an optional lamp member 230. This embodiment is substantially similar to the embodiment depicted in FIGS. 1-8. As previously described, a hole 240 is cut in the siding material 250 of a building 260, roughly corresponding to the recessed portion 270 of the base member 210. The base member 210 is then fastened, e.g., as previously described, to the building 260, e.g., via mounting holes 280, wherein any wires are preferably first threaded through apertures 282. The cover member 220 is then fastened, e.g., as previously described, to the base member 210, e.g., via a tab and slot system, wherein any wires are preferably first threaded through apertures 284. The optional lamp member 230 (or any other component) is then fastened to the cover member 220, wherein any wires are preferably first connected to the optional lamp member 230.

Figure 20:
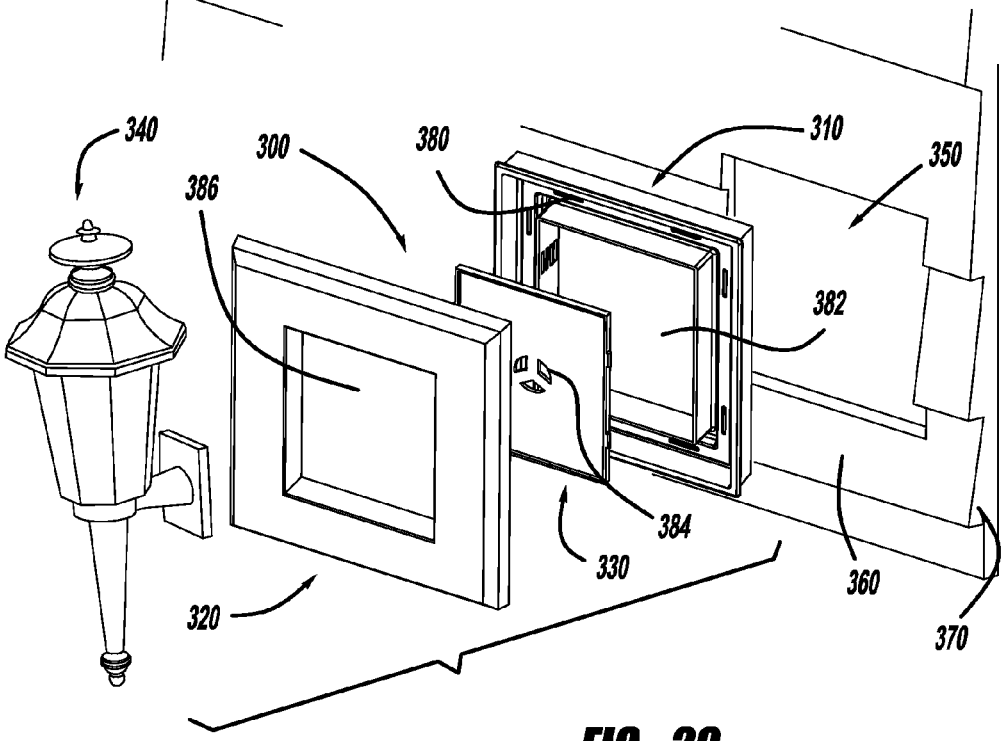
FIG. 20 is an exploded view of a fourth embodiment of a wall mount assembly according to present invention, wherein an optional lamp member is shown for illustrative purposes.
Figure 21:
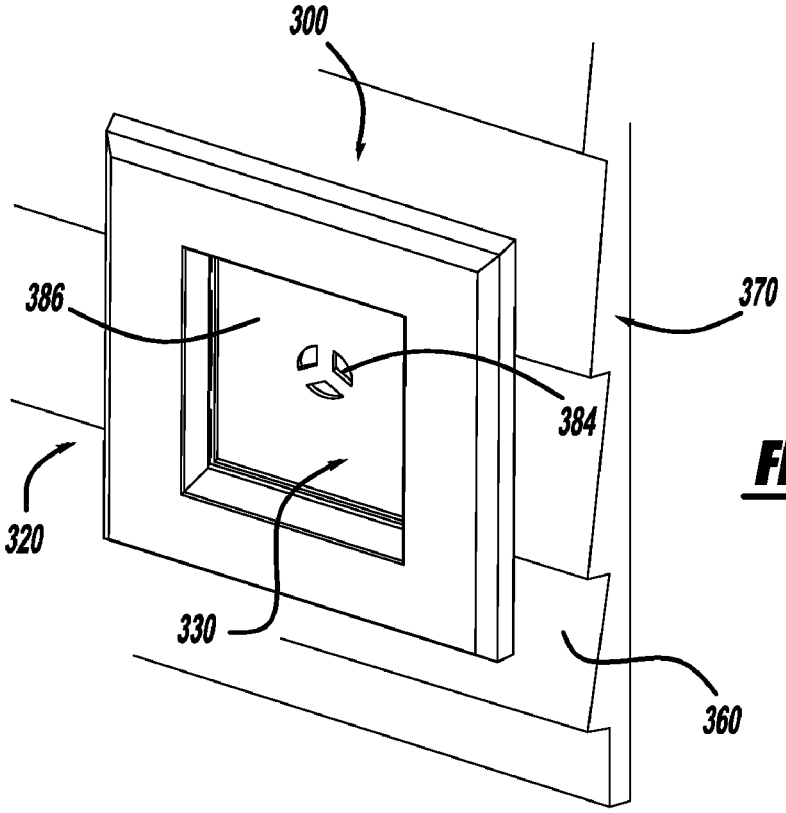
FIG. 21 is a perspective view of the wall mount assembly depicted in FIG. 20.
Figure 22:
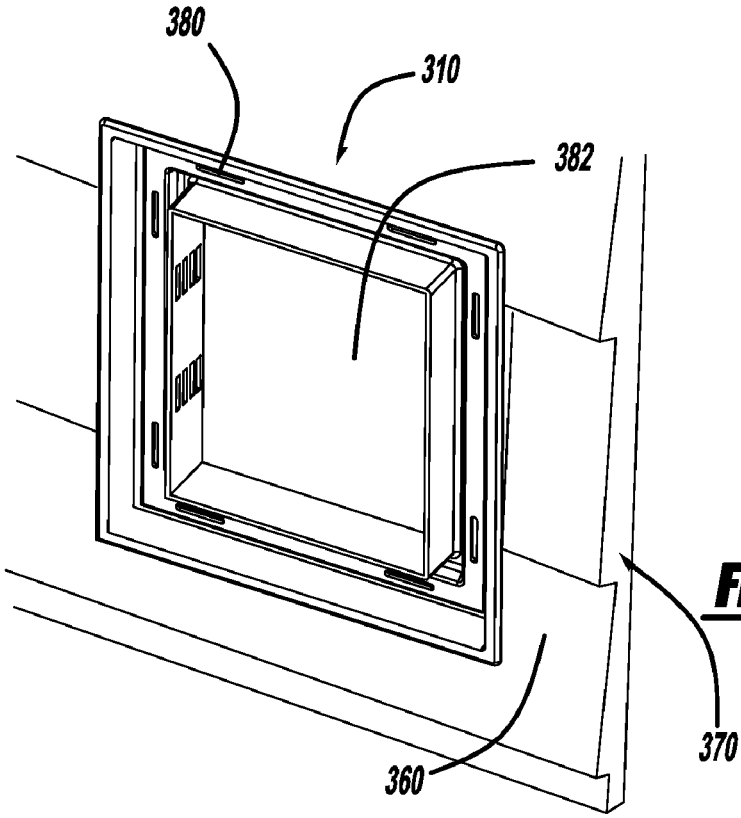
FIG. 22 is a perspective view of the mount assembly depicted in FIG. 20, wherein only the base member is shown mounted to a wall of a building.
Figure 23:
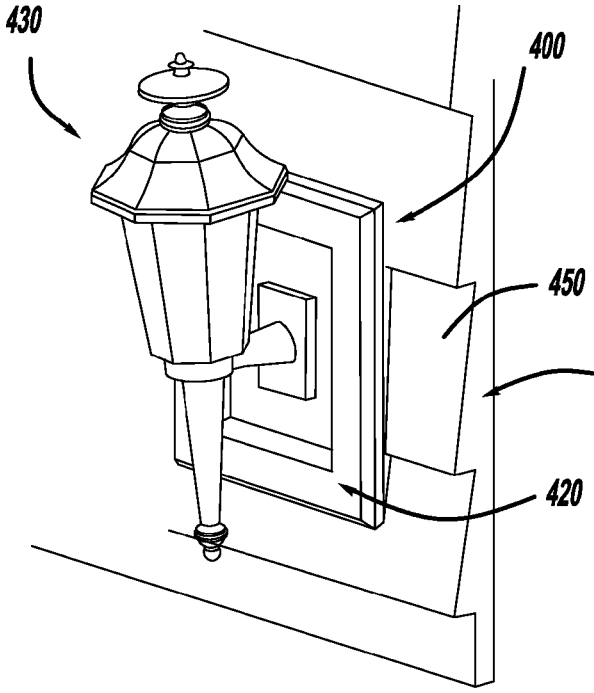
FIG. 23 is a perspective view of a fifth embodiment of a wall mount assembly according to present invention, wherein an optional lamp member is shown for illustrative purposes.
Figure 24:
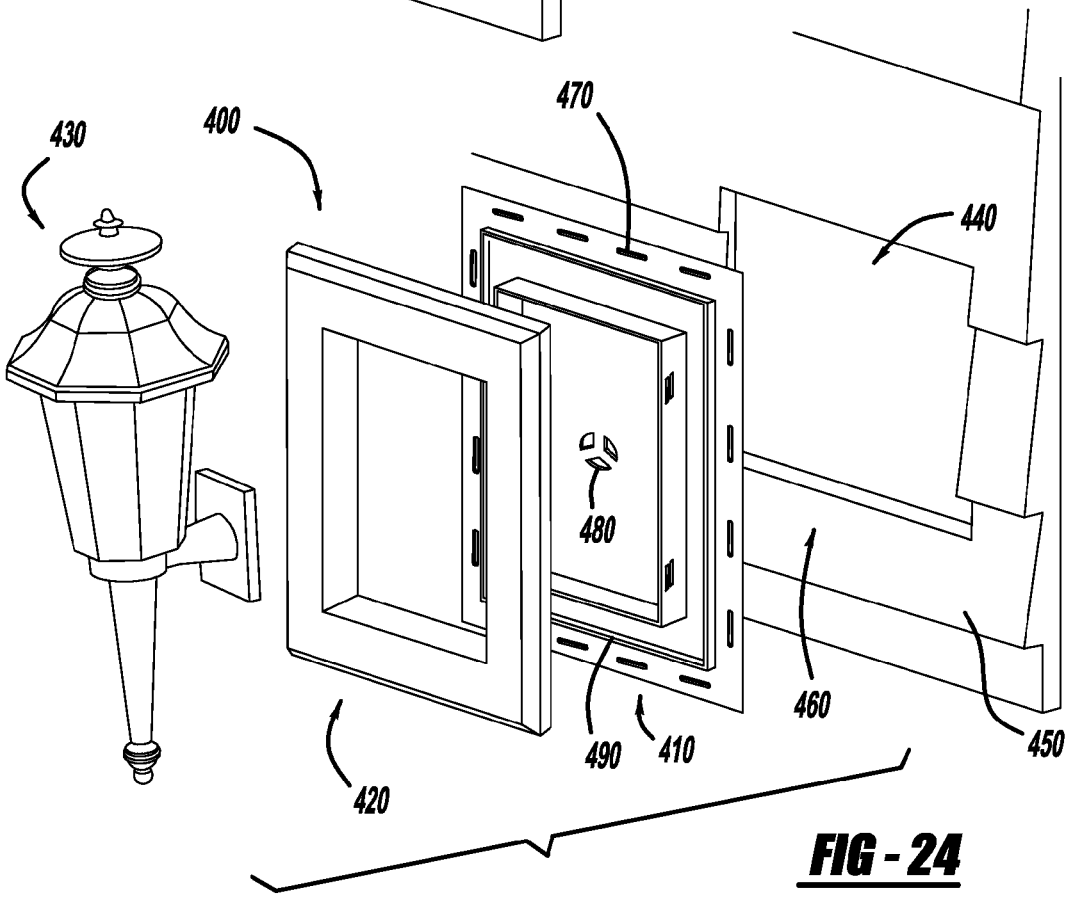
FIG. 24 is an exploded view of the wall mount assembly depicted in FIG. 23, wherein an optional lamp member is shown for illustrative purposes.
Figure 25:
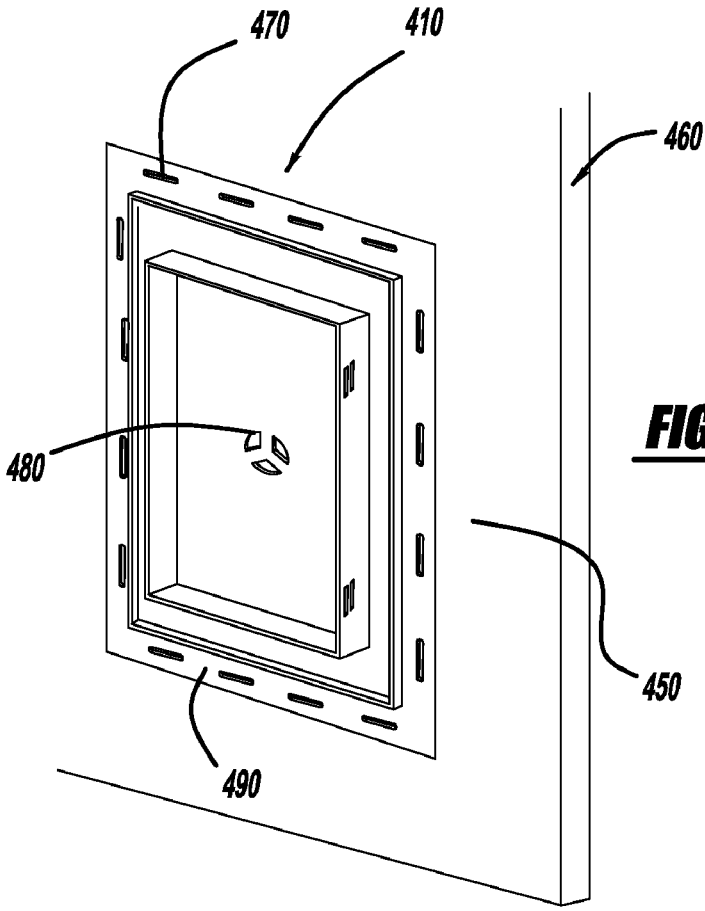
FIG. 25 is a perspective view of the mount assembly depicted in FIG. 23, wherein only the base member is shown mounted to a wall of a building.

Referring specifically to FIGS. 20-22, there is shown a fourth embodiment of a wall mount assembly 300, including a base member 310, a cover member 320, an optional insert member 330, and an optional lamp member 340. This embodiment is substantially similar to the embodiment depicted in FIGS. 9-16. As previously described, a hole 350 is cut in the siding material 360 of a building 370, roughly corresponding to the outer periphery of the base member 310. The base member 310 is then fastened, e.g., as previously described, to the building 370, e.g., via mounting holes 380, wherein any wires are preferably first threaded through aperture 382. The optional insert member 330 is then fastened, e.g., as previously described, to the base member 310, e.g., via a tab and slot system, wherein any wires are preferably first threaded through apertures 384. The cover member 320 is then fastened, e.g., as previously described, to the base member 310, e.g., via a tab and slot system, wherein any wires are preferably first threaded through aperture 386. The optional lamp member 340 (or any other component) is then fastened to the cover member 320, wherein any wires are preferably first connected to the optional lamp member 340.

Figure 26:
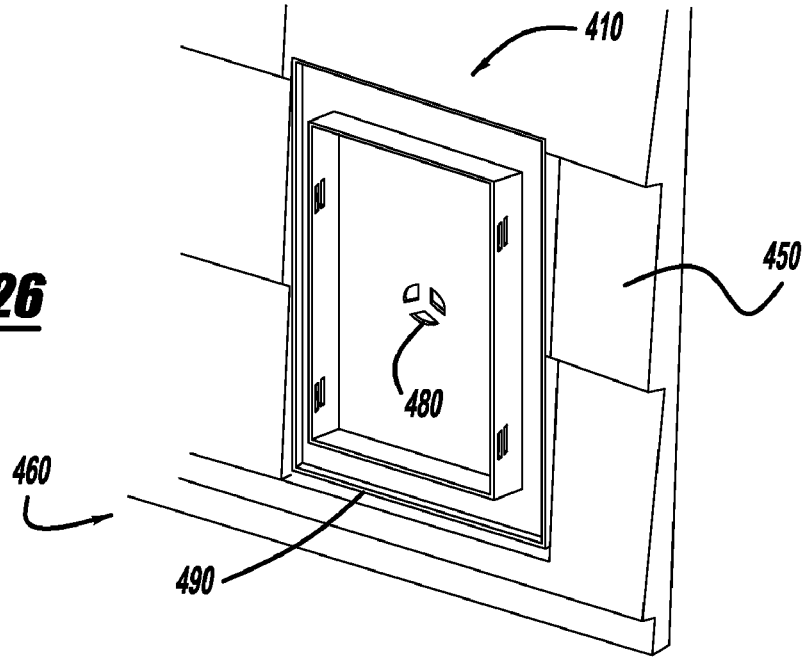
FIG. 26 is a perspective view of the mount assembly depicted in FIG. 25, wherein the apertures or mounting holes of the base member have been sealed.
Figure 27:
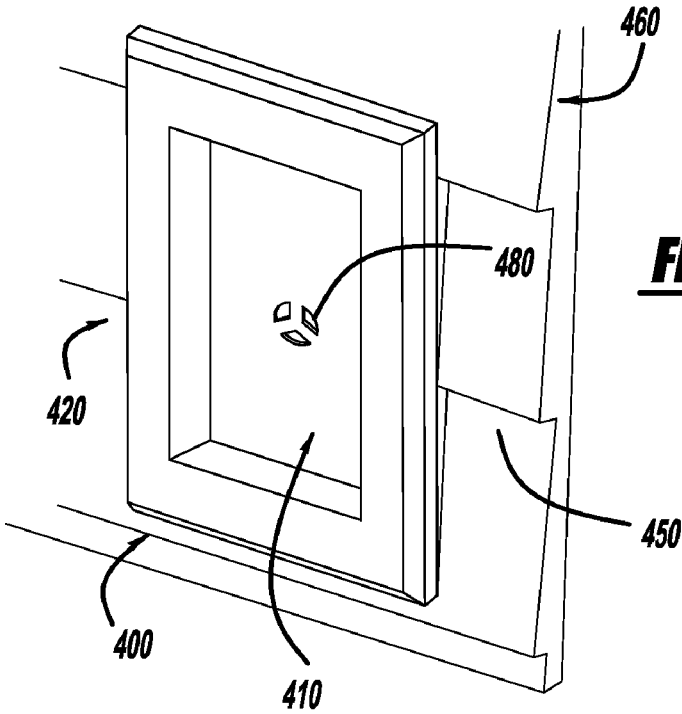
FIG. 27 is a perspective view of the mount assembly depicted in FIG. 23.
Figure 28:
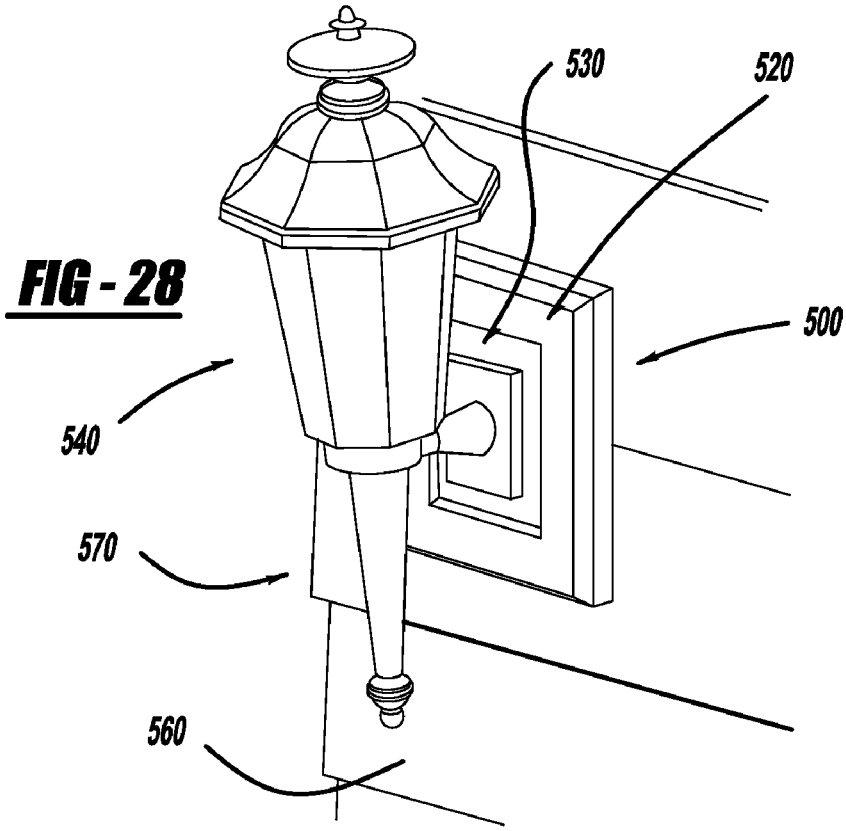
FIG. 28 is a perspective view of a sixth embodiment of a wall mount assembly according to present invention, wherein an optional lamp member is shown for illustrative purposes.
Figure 29:
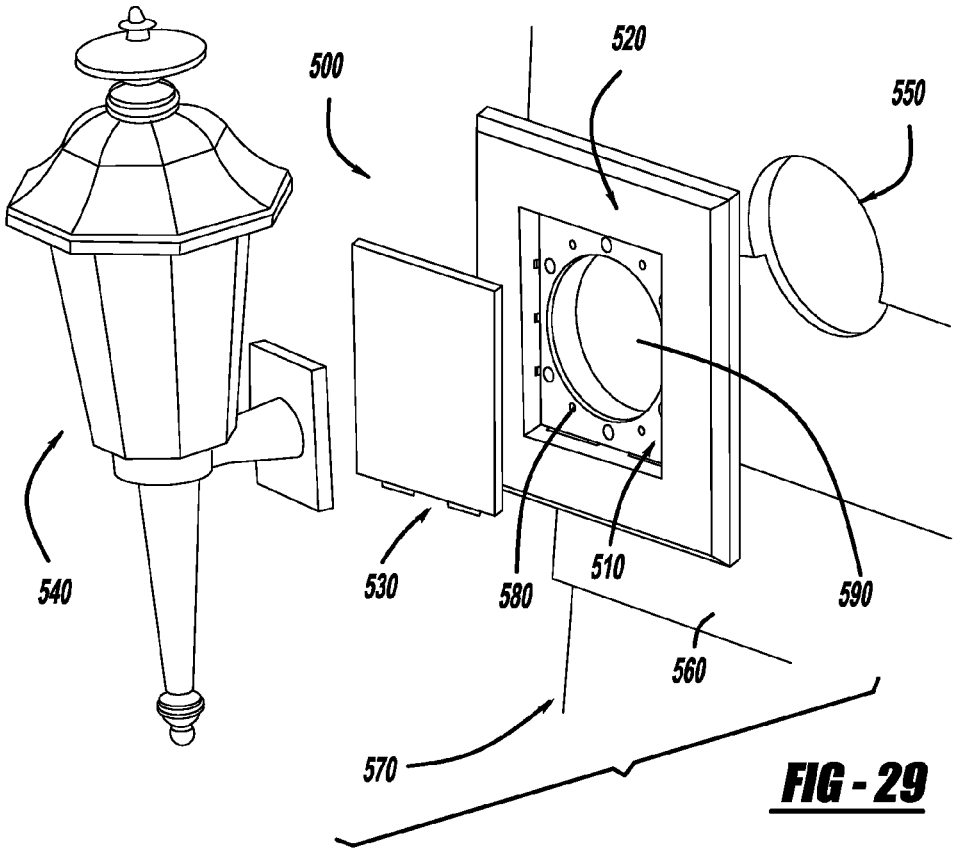
FIG. 29 is an exploded view of the wall mount assembly depicted in FIG. 28, wherein an optional lamp member is shown for illustrative purposes.
Figure 30:
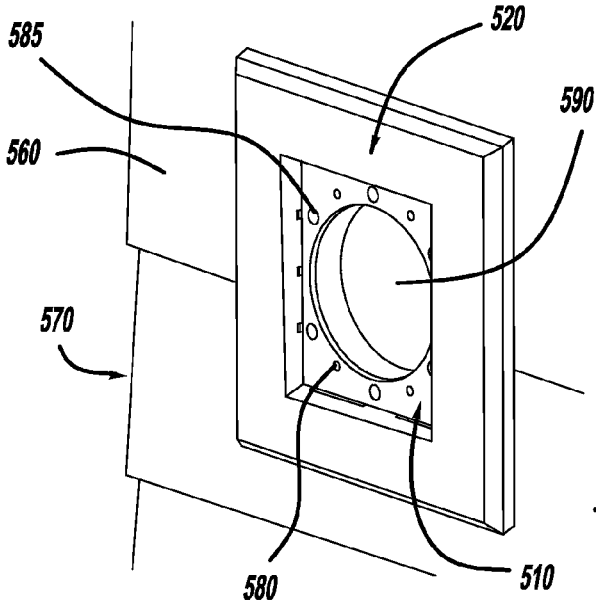
FIG. 30 is a perspective view of the mount assembly depicted in FIG. 28, wherein only the base member is shown mounted to a wall of a building.
Figure 31:
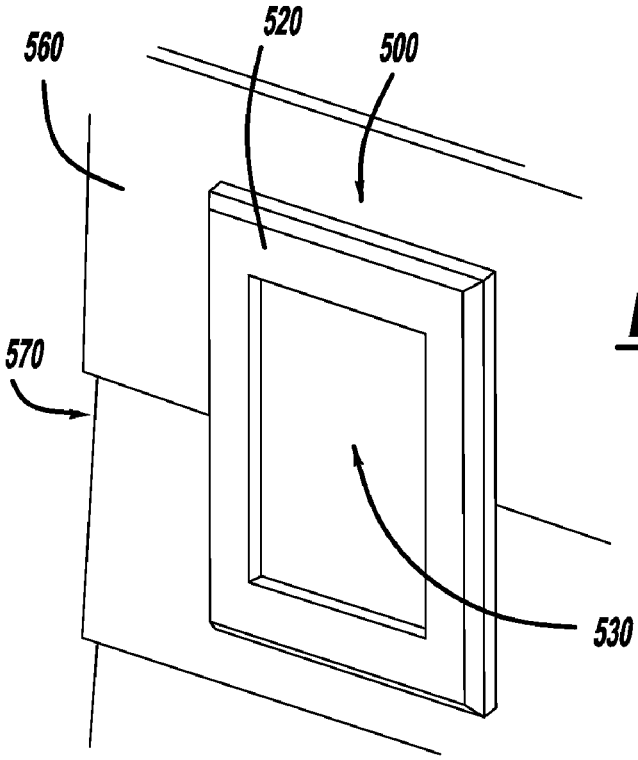
FIG. 31 is a perspective view of the mount assembly depicted in FIG. 28.

Referring specifically to FIGS. 23-27, there is shown a fifth embodiment of a wall mount assembly 400, including a base member 410, a cover member 420, and an optional lamp member 430. This embodiment is somewhat similar to the embodiment depicted in FIGS. 9-16; however, the insert member has been integrated into the base member 410. As previously described, a hole 440 is cut in the siding material 450 of a building 460, roughly corresponding to the outer periphery of the base member 410. The base member 410 is then fastened, e.g., as previously described, to the building 460, e.g., via mounting holes 470, wherein any wires are preferably first threaded through aperture 480. A sealant (e.g., caulk) can be applied to cover any of the mounting holes 470, as shown in FIG. 26. The cover member 420 is then fastened, e.g., as previously described, to the base member 410, e.g., via a tab and slot system, wherein any wires are preferably first threaded through aperture 480. The optional lamp member 430 (or any other component) is then fastened directly to the base member 410 (as opposed to the cover member in the previous embodiment), wherein any wires are preferably first connected to the optional lamp member 430. Additionally in this design, an optional rib member 490, extending around the periphery of the full perimeter and located just inside of the nailing slots, can be used as a guide to align or but the siding material against. This optional rib member 490 also serves as an edge to caulk around the perimeter of the exposed ends of the siding material.

Referring specifically to FIGS. 28-31, there is shown a sixth embodiment of a wall mount assembly 500, including a base member 510, a cover member 520, an optional insert member 530, and an optional lamp member 540. This embodiment is somewhat similar to the embodiment depicted in FIGS. 20-22; however, the cover member 520 has been integrated into the base member 510. As previously described, a hole 550 is cut in the siding material 560 of a building 570, roughly corresponding to the outer periphery of the combined base member 510/cover member 520. The combined base member 510/cover member 520 is then fastened, e.g., as previously described, to the building 570, e.g., via mounting holes 580, wherein any wires are preferably first threaded through aperture 590. Additionally, optional caulking holes 585 can also be provided. These caulking holes 585 are larger than the mounting holes 580 so as to accommodate the tip of a standard caulking tube (not shown). In this manner, the installer can easily caulk the fastener (e.g., screw) attachment points after the combined base member 510/cover member 520 has been attached to the building 570. The caulk can "squirt" or otherwise infiltrate the respective holes (e.g., mounting, caulking, and/or the like) and seal around the fastener (e.g., screw) attachments. The optional insert member 530 is then fastened, e.g., as previously described, to the base member 510, e.g., via a tab and slot system, wherein any wires are preferably first threaded through aperture 590. The optional lamp member 540 (or any other component) is then fastened directly to the optional insert member 530 (as opposed to the base or cover members in the previous embodiments), wherein any wires are preferably first connected to the optional lamp member 540.

Figure 32:
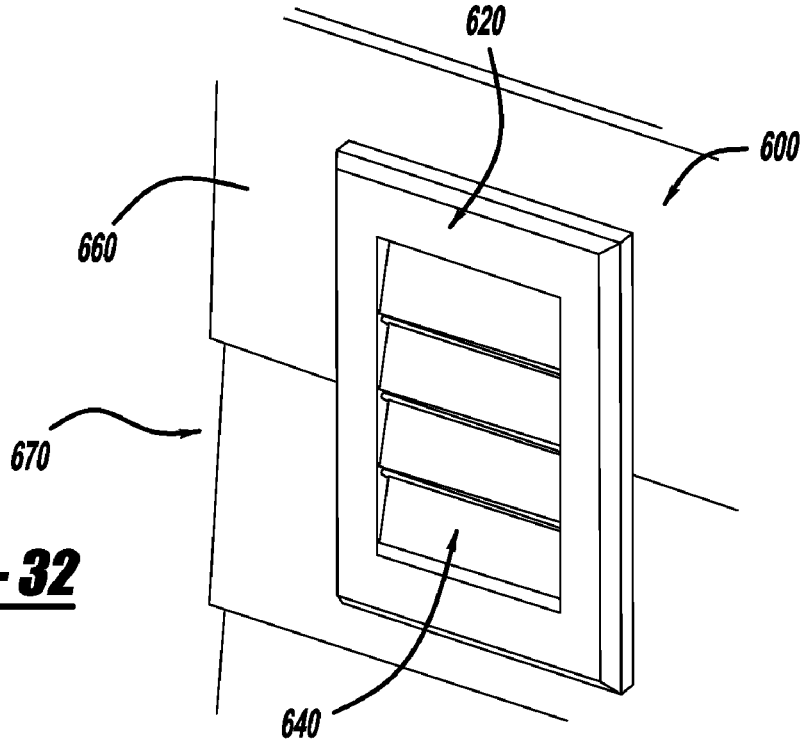
FIG. 32 is a perspective view of a seventh embodiment of a wall mount assembly according to present invention, wherein an optional louver vent member is shown for illustrative purposes.
Figure 33:
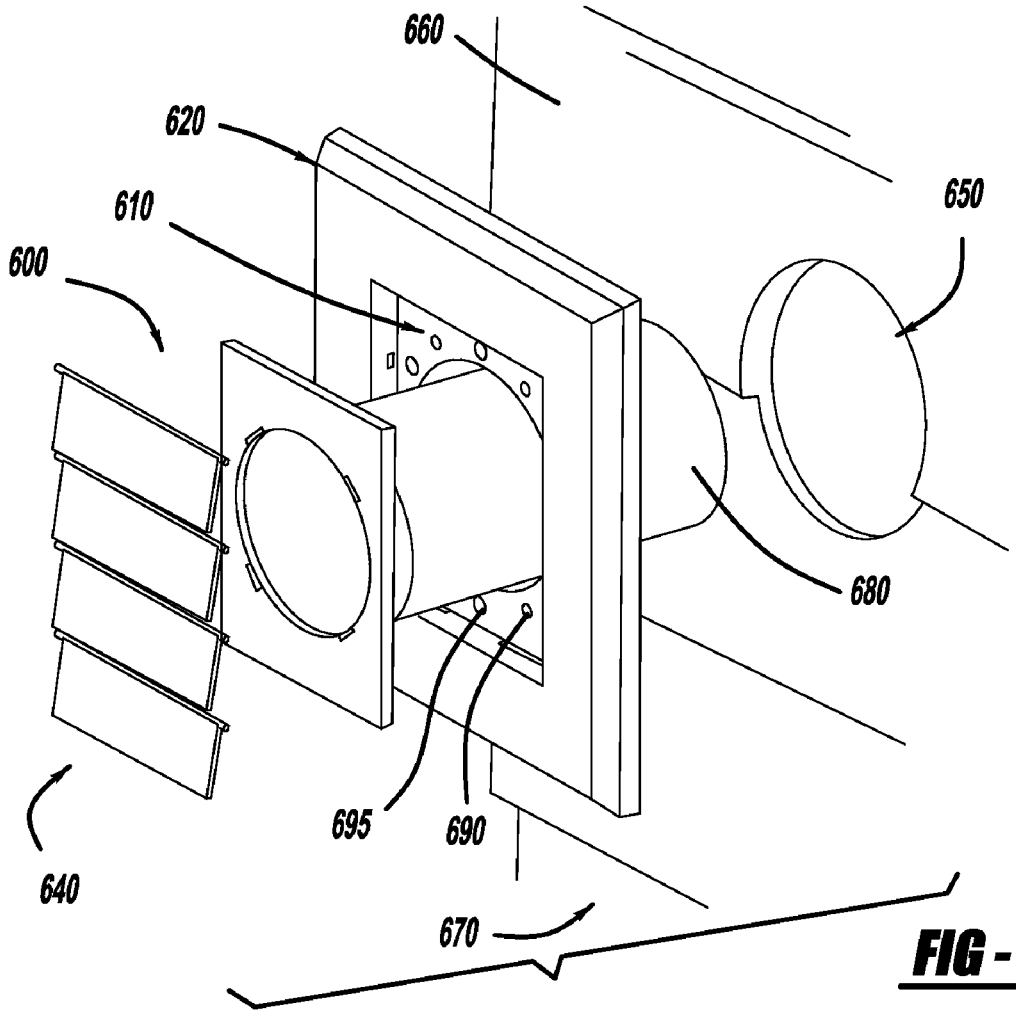
FIG. 33 is an exploded view of the wall mount assembly depicted in FIG. 32, wherein an optional louver vent member is shown for illustrative purposes.

Referring specifically to FIGS. 32-33, there is shown a seventh embodiment of a wall mount assembly 600, including a combined base member 610 and cover member 620, an optional insert member 630, and an optional louver vent member 640. This embodiment is somewhat similar to the embodiment depicted in FIGS. 28-31; however, the optional insert member 630 has been modified significantly. As previously described, a hole 650 is cut in the siding material 660 of a building 670, roughly corresponding to the outer periphery of the tube portion 680 of the optional insert member 630. The combined base member 610/cover member 620 is then fastened, e.g., as previously described, to the building 670, e.g., via mounting holes 690. Additionally, optional caulking holes 695 can also be provided. These caulking holes 695 are larger than the mounting holes 690 so as to accommodate the tip of a standard caulking tube (not shown). In this manner, the installer can easily caulk the fastener (e.g., screw) attachment points after the combined base member 610/cover member 620 has been attached to the building 670. The caulk can "squirt" or otherwise infiltrate the respective holes (e.g., mounting, caulking, and/or the like) and seal around the fastener (e.g., screw) attachments. The optional insert member 630 is then fastened, e.g., as previously described, to the base member 610, e.g., via a tab and slot system. The optional louver vent member 640 (or any other component) is then fastened, e.g., as previously described, to the base member 610, e.g., via a tab and slot system, such that each of the individual louvers of the optional louver vent member 640 can rotate about a tab or pin member disposed in a slot or groove formed in the base member 610. By way of a non-limiting example, each of the louvers extend the width of the recessed portion of the base member 610 and have mounting pins for engaging mounting holes formed on the base member 610 so as to be mounted within the recessed portion of the base member 610, wherein the louvers are able to pivot about the mounting pins for allowing exhaust to escape and for preventing access into the exhaust vent.

Figure 34:
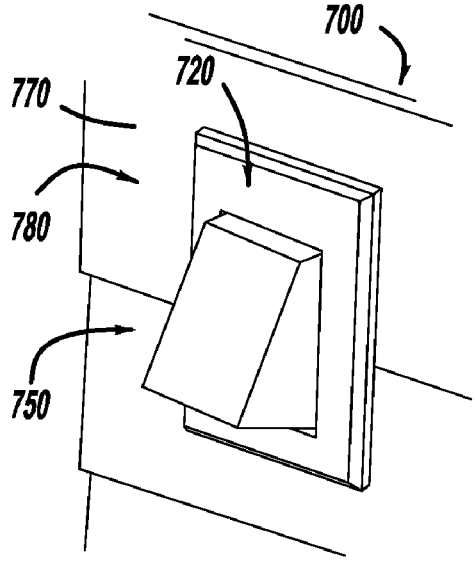
FIG. 34 is a perspective view of an eighth embodiment of a wall mount assembly according to present invention, wherein an optional exhaust vent member is shown for illustrative purposes.
Figure 35:
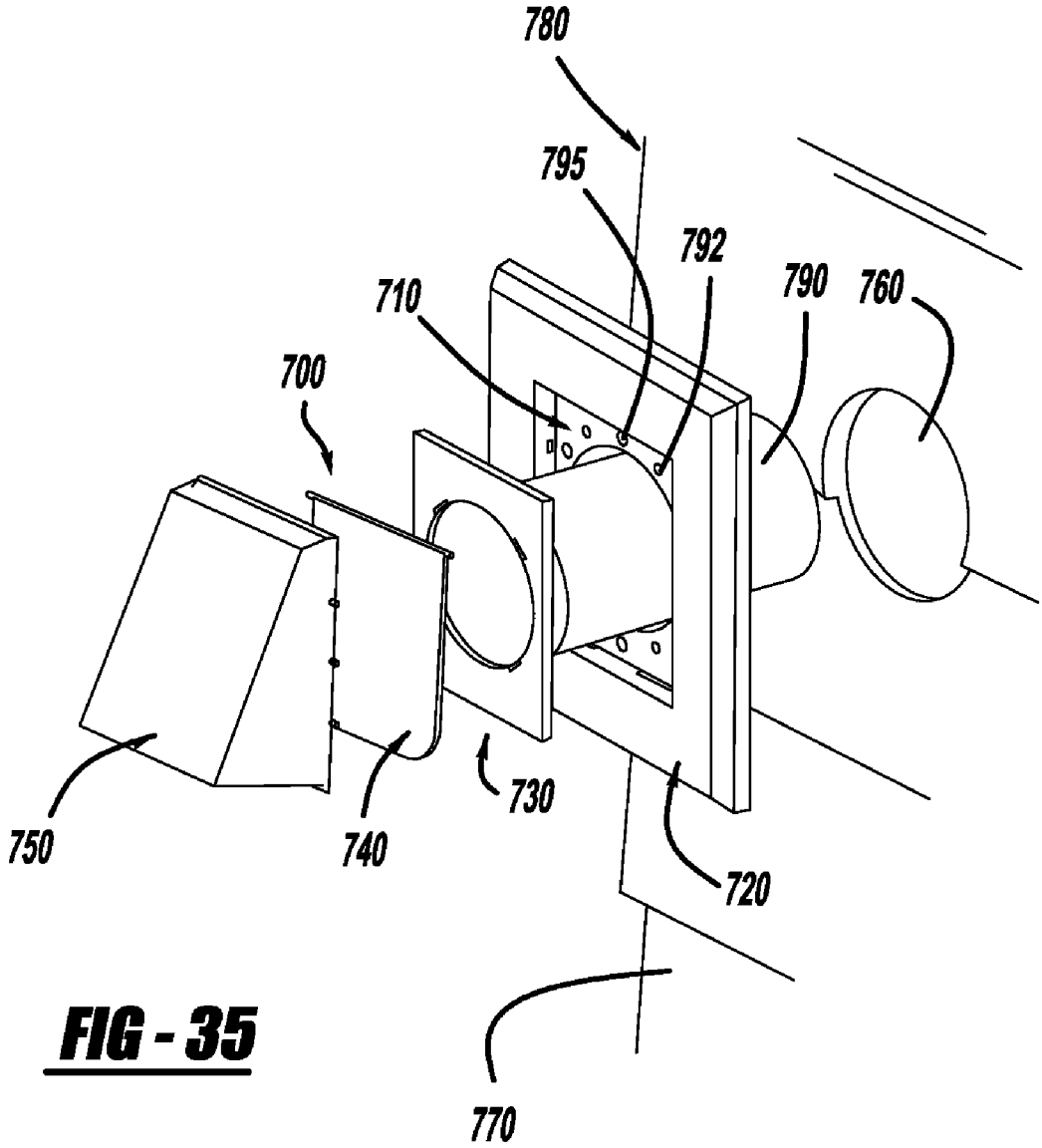
FIG. 35 is an exploded view of the wall mount assembly depicted in FIG. 34, wherein an optional louver vent member is shown for illustrative purposes.

Referring specifically to FIGS. 34-35, there is shown an eighth embodiment of a wall mount assembly 700, including a combined base member 710 and cover member 720, an optional insert member 730, an optional flap member 740, and an optional exhaust vent member 750. This embodiment is somewhat similar to the embodiment depicted in FIGS. 32-33. As previously described, a hole 760 is cut in the siding material 770 of a building 780, roughly corresponding to the outer periphery of the tube portion 790 of the optional insert member 730. The combined base member 710/cover member 720 is then fastened, e.g., as previously described, to the building 780, e.g., via mounting holes 792. Additionally, optional caulking holes 795 can also be provided. These caulking holes 795 are larger than the mounting holes 792 so as to accommodate the tip of a standard caulking tube (not shown). In this manner, the installer can easily caulk the fastener (e.g., screw) attachment points after the combined base member 710/cover member 720 has been attached to the building 780. The caulk can "squirt" or otherwise infiltrate the respective holes (e.g., mounting, caulking, and/or the like) and seal around the fastener (e.g., screw) attachments. The optional insert member 730 is then fastened, e.g., as previously described, to the base member 710, e.g., via a tab and slot system. The optional flap member 740 is then fastened, e.g., as previously described, to the base member 710, e.g., via a tab and slot system, such that the optional flap member 740 can rotate about a tab or pin member disposed in a slot or groove formed in the base member 710. The optional exhaust vent member 740 (or any other component) is then fastened, e.g., as previously described, to the base member 710, e.g., via a tab and slot system. By way of a non-limiting example, the optional flap member 740 and the exhaust vent member 750 are preferably shaped according to the shape of the recessed portion of the base member 710. The optional flap member 740 defines an outer periphery and has a rod extending from the outer periphery for engaging mounting holes in the recessed portion of the base member 710. The optional flap member 740 is able to pivot about the rod. The optional exhaust vent member 750 has mounting pins for engaging the remaining mounting holes of the base member 710 and mounts about the optional flap member 740. Once assembled, the optional flap member 740 is able to freely open and close within the optional exhaust vent member 750 to allow exhaust to escape from the exhaust vent.

The base members formed according to the present invention can be used as a universal connector for various cover members, e.g., as described above. Because a single base member is operable with different cover members, manufacturing costs are lessened and installation is simplified. Additionally, because the present invention mounts directly to the building without a member mounted beneath the siding material, the wall mount assemblies of the present invention can be added to existing buildings without having to remove the siding material. Installation only requires a small portion of the siding material to be removed, such as by cutting a hole, that corresponds to the annular flange of the base portion or an outer periphery of the base portion or a combined base portion/cover portion.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A mounting assembly operable to provide a wall mount for fastening to a structure, comprising:

a base member including:

a substantially planar portion having a front surface and a rear surface being substantially parallel to each other;

a wall member extending away from the front surface at an outer periphery of the base member and including a shoulder portion extending therearound;

an annular flange member defining a recessed portion and extending from the substantially planar portion to a distal end;

an end wall member disposed at the distal end of the annular flange and being substantially parallel to the front surface and the rear surface; and a plurality of bosses each extending from the front surface and along the annular flange member in the recessed portion, the plurality of bosses being spaced from each other about the annular flange member;

each boss defining a fastening hole extending through the boss for receiving a fastener to secure the base member to the structure; and a cover member having a wall member extending about an outer periphery and a plurality of wedge members that abut the shoulder portion of the base member to removeably mount the cover member to the base member.

2. The mounting assembly according to claim 1, wherein the cover member defines apertures for receiving electrical wires.

3. The mounting assembly according to claim 1, wherein the end wall member defines apertures for receiving electrical wires.

4. The mounting assembly according to claim 1, wherein the cover member defines apertures for receiving electrical wires and the end wall member defines apertures substantially aligned with apertures of the cover for receiving the electrical wires.

5. The mounting assembly according to claim 1, wherein the wall member of the cover member abuts the wall member of the base member.

6. The mounting assembly according to claim 1 wherein the shoulder portion of the base member includes an outer shoulder portion and an inner shoulder portion and wherein the cover member is resiliently flexible to pass over the outer shoulder member and onto the inner shoulder member when the cover member is assembled to the base member.

7. The mounting assembly according to claim 1, further comprising an electrical component mounted to the cover member.

8. A mounting assembly operable to provide a vent hood for fastening to a structure, comprising:

a base member including:

a substantially planar portion having a front surface and a rear surface;

a wall member extending away from the front surface at an outer periphery of the base member and, including a shoulder portion extending therearound;

an annular flange member extending from the substantially planar portion to a distal end;

an end wall member disposed at the distal end and being substantially parallel to the front surface and the rear surface; and a plurality of bosses each extending from the front surface and along the annular flange member, the plurality of bosses being spaced from each other about the annular flange member;

each boss defining a fastening hole extending through the boss for receiving a fastener to secure the base member to the structure;

a cover member having a wall member extending about an outer periphery and a plurality of wedge members that abut the shoulder portion of the base member to removeably mount the cover member to the base member;

an electrical component mounted to the cover member; and wherein the shoulder portion of the base member includes an outer shoulder portion and an inner shoulder portion and wherein the cover member is resiliently flexible to pass over the outer shoulder member and onto the inner shoulder member when the cover member is assembled to the base member.

9. The mounting assembly according to claim 7, wherein the cover member defines apertures receiving electrical wires of the electrical component and wherein the end wall member defines apertures substantially aligned with apertures of the cover receiving the electrical wires.

10. The mounting assembly according to claim 8 wherein the cover member defines apertures receiving electrical wires of the electrical component and wherein the end wall member defines apertures substantially aligned with apertures of the cover receiving the electrical wires.

11. The mounting assembly according to claim 8, wherein the cover member defines apertures receiving electrical wires of the electrical component.

12. The mounting assembly according to claim 8, wherein the end wall member defines apertures receiving electrical wires of the electrical component.

13. The mounting assembly according to claim 8, wherein the wall member of the cover member abuts the wall member of the base member.

* * * * *